US009181070B2

(12) United States Patent
Sugano et al.

(10) Patent No.: US 9,181,070 B2
(45) Date of Patent: Nov. 10, 2015

(54) HYDRAULIC DRIVING APPARATUS FOR WORKING MACHINE

(75) Inventors: Naoki Sugano, Kobe (JP); Satoshi Maekawa, Kobe (JP); Katsuki Yamagata, Akashi (JP); Takaharu Michida, Akashi (JP); Hiroo Kondo, Akashi (JP); Naoya Kitazumi, Akashi (JP); Naoto Hori, Akashi (JP)

(73) Assignees: KABUSHIKI KAISHA KOBE SEIKO SHO, Kobe-shi (JP); KOBELCO CRANES CO., LTD., Tokyo (JP)

( * ) Notice: Subject to any disclaimer, the term of this patent is extended or adjusted under 35 U.S.C. 154(b) by 730 days.

(21) Appl. No.: 13/467,340

(22) Filed: May 9, 2012

(65) Prior Publication Data

US 2012/0285159 A1 Nov. 15, 2012

(30) Foreign Application Priority Data

May 13, 2011 (JP) ..... 2011-108293
Sep. 26, 2011 (JP) ..... 2011-209678

(51) Int. Cl.
*F15B 15/20* (2006.01)
*B66D 1/44* (2006.01)
*F15B 11/044* (2006.01)

(52) U.S. Cl.
CPC ..... *B66D 1/44* (2013.01); *F15B 11/0445* (2013.01); *F15B 2211/20546* (2013.01); *F15B 2211/3116* (2013.01); *F15B 2211/40569* (2013.01);

(Continued)

(58) Field of Classification Search
CPC ..... B66D 1/44; F15B 11/0445
USPC ..... 60/356, 422, 445, 446, 468
See application file for complete search history.

(56) References Cited

U.S. PATENT DOCUMENTS 3,895,564 A * 7/1975 Pinson ..... 91/418
5,884,984 A 3/1999 Arai et al.

(Continued)

FOREIGN PATENT DOCUMENTS

CN 1174596 A 2/1998
CN 1697933 A 11/2005

(Continued)

OTHER PUBLICATIONS

U.S. Appl. No. 13/467,453, filed May 9, 2012, Sugano, et al.
Office Action issued Mar. 18, 2013, in German Patent Application No. 10 2012 207 880.0 with English translation.
U.S. Appl. No. 13/713,680, filed Dec. 13, 2012, Kondo, et al.

*Primary Examiner* — Dwayne J White
*Assistant Examiner* — Matthew Wiblin
(74) *Attorney, Agent, or Firm* — Oblon, McClelland, Maier & Neustadt, L.L.P.

(57) ABSTRACT

Provided is an apparatus provided in a working machine to lower a load, comprising a hydraulic pump, a hydraulic actuator, a manipulation device having a manipulation member, a meter-in flow control device, a meter-out flow control device, a back pressure valve, a regeneration fluid passage branched from the meter-out fluid passage at a position upstream of the back pressure valve and merged with the meter-in fluid passage, and a check valve. The meter-in flow control device controls a meter-in flow rate in a region of the meter-in fluid passage upstream of a merging point with the regeneration fluid passage. The meter-out flow control device controls a meter-out flow rate in a region of the meter-out fluid passage upstream of a branching point of the regeneration fluid passage so as to make the meter-out flow rate be greater than the meter-in flow rate.

6 Claims, 15 Drawing Sheets

(52) U.S. Cl.
CPC ..... *F15B2211/46* (2013.01); *F15B 2211/7058* (2013.01); *F15B 2211/761* (2013.01)

(56) References Cited

U.S. PATENT DOCUMENTS

| | | | | |
|---|---|---|---|---|
| 6,378,303 | B1 * | 4/2002 | Higuchi et al. | 60/468 |
| 6,393,838 | B1 * | 5/2002 | Moriya et al. | 60/422 |
| 2005/0011190 | A1 * | 1/2005 | Bitter | 60/468 |
| 2006/0048508 | A1 | 3/2006 | Nakamura et al. | |
| 2007/0151238 | A1 * | 7/2007 | Kraft | 60/445 |
| 2009/0308068 | A1 | 12/2009 | Yoshino | |

FOREIGN PATENT DOCUMENTS

| | | | |
|---|---|---|---|
| CN | 1914384 | A | 2/2007 |
| DE | 27 19 585 | C2 | 4/1982 |
| DE | 199 13 277 | B4 | 11/2007 |
| JP | 10-267007 | | 10/1998 |
| JP | 2000-310201 | | 11/2000 |
| WO | WO 2008147303 | A1 * | 12/2008 |

* cited by examiner

HYDRAULIC DRIVING APPARATUS FOR WORKING MACHINE

BACKGROUND OF THE INVENTION

1. Field of the Invention

The present invention relates to a hydraulic driving apparatus provided in a working machine, such as a crane, to move a load, such as a suspended load.

2. Description of the Background Art

As a hydraulic driving apparatus provided in a working machine, there is known a type equipped with a hydraulic actuator, as described, for example, in JP 2000-310201 A, which will be called "Patent Document 1" below. In this type, the hydraulic actuator can be operated to move a load in the same direction as a self-weight falling direction which is a direction along which the load falls by its self-weight. Patent Document 1 discloses a lowering hydraulic circuit for operating a hydraulic motor serving as the hydraulic actuator, to move a suspended load in a lowering direction.

In the above working hydraulic driving apparatus, cavitation is likely to occur during a lowering drive mode in which the hydraulic motor is driven (operated) in a rotational direction corresponding to the lowering direction. Specifically, during the lowering drive mode, the self-weight of the suspended load increases the rotational speed of the hydraulic motor, which may cause a flow rate adsorbed by the hydraulic motor to be greater than a flow rate of hydraulic fluid supplied from a hydraulic pump to the hydraulic motor. This may lower a pressure of a meter-in fluid passage which is a fluid passage on a hydraulic fluid supply side of the hydraulic motor, namely a meter-in pressure, to generate cavitation in the meter-in fluid passage. The cavitation possibly steals a braking force from the hydraulic motor and possibly causes falling of the suspended load.

To suppress cavitation thus generated in a meter-in fluid passage, Patent Document 1 discloses an external pilot-operated counterbalance valve (hereinafter referred to simply as "counterbalance valve") provided in a meter-out fluid passage, that is, a fluid passage on a hydraulic fluid discharge side of the hydraulic motor (counterbalance valve 11 in FIG. 1 of Patent Document 1). The counterbalance valve is applied with a meter-in pressure as a pilot pressure and applied with a set pressure P1 thereof by means of a spring or the like. The counterbalance valve has a variable valve opening degree, which is increased when the meter-in pressure becomes greater than the set pressure P1 while reduced when the meter-in pressure becomes lower than the set pressure P1. The counterbalance valve narrows down the meter-out fluid passage when the valve opening degree is reduced, thus producing a braking force in the hydraulic motor to decelerate the hydraulic motor and thereby suppress the flow rate adsorbed by the hydraulic motor. The counterbalance valve thus keeps the meter-in pressure to the set pressure P1 or below, thereby suppressing the cavitation in the meter-in fluid passage.

FIG. 16 shows a conventional working hydraulic driving apparatus 701, which comprises an external pilot-operated counterbalance valve 784. The counterbalance valve 784 has a measurement point on the meter-in fluid passage 30 and a control point is located on the meter-out fluid passage 40; these forms an unstable control system which is not co-located under the control theory.

This unstable control system is likely to cause hunting in rotational speed of the hydraulic motor 13. For example, when a manipulation lever 16 shown in FIG. 16 is manually operated from a neutral position to a lowering position thereof at a time T0, an amount of hydraulic fluid to be supplied to the hydraulic motor 13 through a direction selector valve 20 is increased according to the manual operation, thus increasing a meter-in pressure of the meter-in fluid passage 30. The counterbalance valve 784, detecting the increase in the meter-in pressure, is operated in a valve-opening direction; however, the difference between the measurement point and the control point of the counterbalance valve 784 intends to cause a time lag from a change in the meter-in pressure to a real movement of the valve spool of the counterbalance valve 784. This time lag repetitively increases and reduces the valve opening degree of the counterbalance valve 784 as shown in FIG. 17A, thereby oscillating the meter-in pressure as shown in FIG. 17B. This results in a possibility of an oscillation in rotational speed of the hydraulic motor 13 (see FIG. 16), that is, a hunting.

As means for suppressing such hunting, it is conceivable to provide an orifice 786 shown in FIG. 16 in a pilot line 785 for the counterbalance valve 784. The orifice 786 makes the counterbalance valve 784 be gradually opened according to an increase in the meter-in pressure. In other words, the orifice 786 provides attenuation to a movement of the counterbalance valve 784 in a direction from a closed state to an opened state, thereby making a response of the valve 784 slow.

The orifice 786, however, generates flow resistance due to the throttle of the meter-out fluid passage by the counterbalance valve 784, until the counterbalance valve 784 will have reached an adequate valve opening degree A1 as shown in FIG. 18A, thereby possibly generating an unnecessary boosted pressure in the meter-in fluid pressure 30, as indicated by the shadow area in FIG. 18, which possibly results in deteriorated fuel economy.

Patent Document 1 discloses a technique of providing a flow regulation valve in order to suppress the hunting. This flow regulation valve is operable to control a flow rate in the meter-in fluid passage so as to reduce the pressure difference between the meter-in fluid passage and the meter-out fluid passage. This however causes a problem that an operating speed (lowering speed) of the hydraulic motor is largely varied depending on a mass of the load. The reason is as follows.

When a hydraulic driving apparatus is operated in a direction to move a load downward, i.e., in a lowering direction, a holding pressure appropriate for a mass of the load is generally produced in a meter-out fluid passage. This holding pressure becomes higher when the load is relatively heavy, than when the load is relatively light. The flow regulation valve disclosed in the Patent Document 1 opens more largely as the holding pressure becomes higher. This increases a flow rate in the meter-in fluid passage, that is, a meter-in flow rate, and operating speed of the hydraulic motor. Hence, the lowering speed becomes higher in the case of a relatively heavy load than in the case of a relatively light load. In other words, even if a manipulation lever is not changed, the operating speed of the hydraulic motor can be varied depending on a level of weight of the load. This deteriorates operability.

JP 10-267007 A, which will be called Patent Document 2 below, discloses a regeneration circuit, for example, shown in FIG. 5 of Patent Document 2. This regeneration circuit comprises an orifice provided in a meter-out fluid passage and a regeneration fluid passage for communicating an upstream side of the orifice and a meter-in fluid passage. The regeneration circuit allows a part of hydraulic fluid flowing through the meter-out fluid passage to be returned to the meter-in fluid passage through the regeneration fluid passage, thereby increasing respective operating speeds of a hydraulic actuator and an attachment adapted to be driven by the hydraulic actuator.

If the regeneration circuit disclosed in Patent Document 2 were applied to a circuit where a hydraulic motor is used to lower a suspended load as disclosed in the Patent Document 1, a flow rate in the regeneration fluid passage (regeneration flow rate) would be increased along with an increase in weight of the suspended load. This makes the lowering speed become higher as the suspended load becomes heavier, resulting in a loss of safety and operability. Moreover, the technique disclosed in the Patent Document 2, which does not compensate for a minimum pressure of the meter-in fluid passage, has a possibility of cavitation in the meter-in fluid passage, which may cause the hydraulic motor to stall.

SUMMARY OF THE INVENTION

An object of the present invention is to provide a hydraulic driving apparatus provided in a working machine to move a load in the same direction as a direction along which the load falls by its self-weight, capable of suppressing: cavitation in a meter-in fluid passage; hunting of a driving speed; deterioration in response and fuel economy which would otherwise be caused by suppressing the hunting; and a change in speed of a load depending on a level of weight of the load. The hydraulic driving apparatus provided by the present invention comprises a hydraulic pump, a hydraulic actuator adapted to be supplied with hydraulic fluid from the hydraulic pump to move the load, and a manipulation device having a manipulation member adapted to be operated to designate an operating speed of the hydraulic actuator. The hydraulic driving apparatus further comprises: a meter-in flow control device for controlling a meter-in flow rate which is a flow rate in a meter-in fluid passage for the hydraulic actuator; a meter-out flow control device for controlling a meter-out flow rate which is a flow rate in a meter-out fluid passage for the hydraulic actuator, the meter-out flow control device including a meter-out orifice provided in the meter-out fluid passage for the hydraulic actuator and has an opening degree variable depending on an operation amount of the manipulation member, and a meter-out flow regulation valve for changing the flow rate in the meter-out fluid passage so as to keep an inlet-outlet pressure difference of the meter-out orifice at a constant set pressure difference; a back pressure valve provided downstream of the meter-out orifice and downstream of the meter-out flow regulation valve, to produce a set back pressure on an upstream side thereof; a regeneration fluid passage branched from the meter-out fluid passage at a position upstream of the back pressure valve and merged with the meter-in fluid passage; and a check valve provided in the regeneration fluid passage to allow hydraulic fluid to pass therethrough only in a flow direction from the meter-out fluid passage to the meter-in fluid passage. The meter-in flow control device is operable to control the meter-in flow rate in a region of the meter-in fluid passage upstream of a merging point with the regeneration fluid passage. The meter-out flow control device is operable to control the meter-out flow rate in a region of the meter-out fluid passage upstream of a branching point of the regeneration fluid passage so as to make the meter-out flow rate in the region be greater than the meter-in flow rate in the region.

DESCRIPTION OF THE PREFERRED EMBODIMENTS

With reference to FIGS. 1 to 7, a first embodiment of the present invention will be described.

Figure 1:
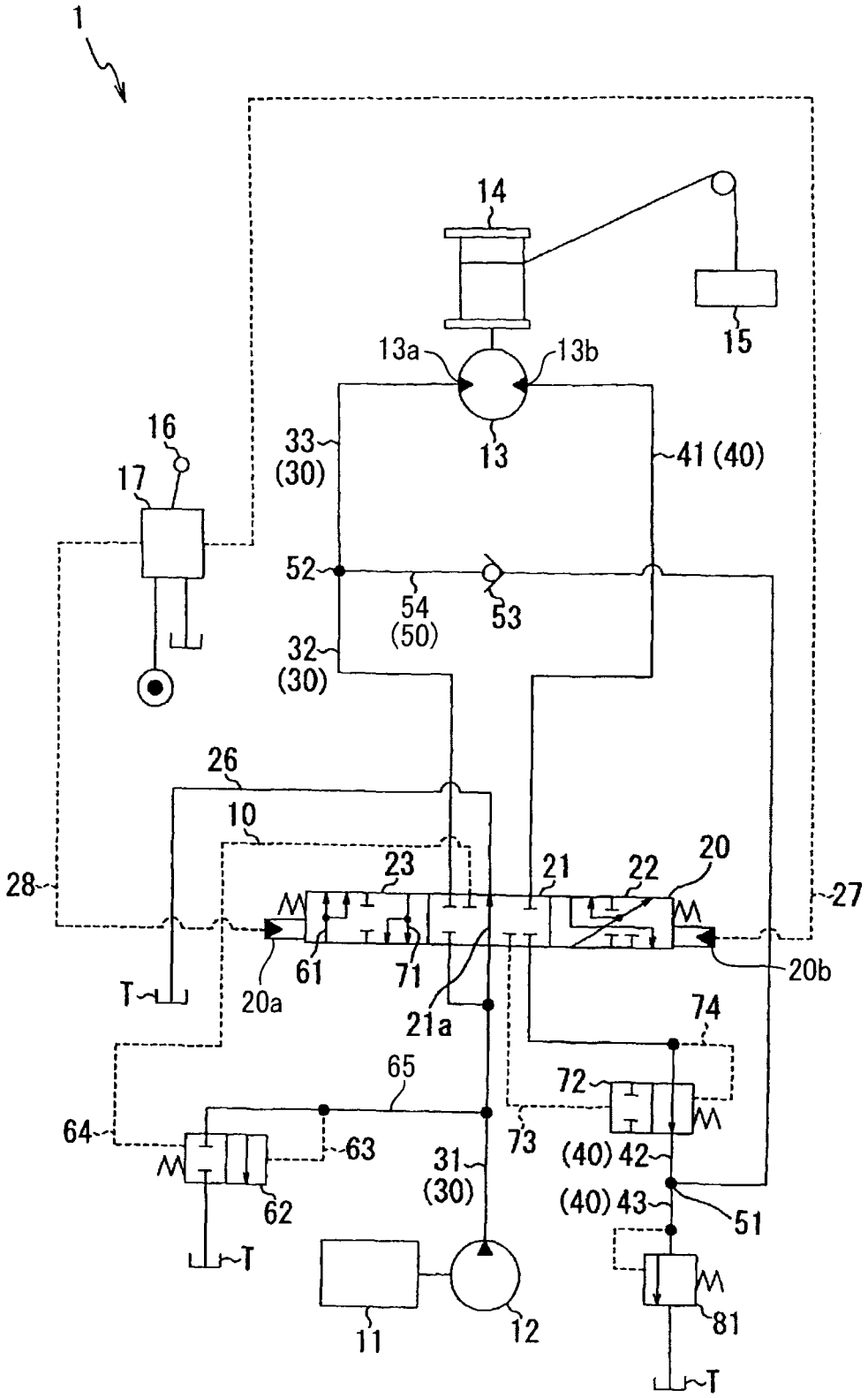
FIG. 1 is a circuit diagram showing a hydraulic driving apparatus, for a working machine, according to a first embodiment of the present invention.

FIG. 1 shows a hydraulic driving apparatus 1 according to the first embodiment. The hydraulic driving apparatus 1 is provided in a working machine, such as a crane, to move a load thereof (in FIG. 1, a suspended load 15). The hydraulic driving apparatus 1 comprises: an engine 11 serving as a driving power source; a hydraulic pump 12 adapted to be driven by the engine 11; a hydraulic motor 13 serving as a hydraulic actuator adapted to be driven by hydraulic fluid supplied from the hydraulic pump 12; a direction selector valve 20 provided between the hydraulic pump 12 and the hydraulic motor 13; and a remote-control valve 17 connected to the direction selector valve 20, the remote-control valve 17 having a manipulation lever 16 as a manipulation member. The hydraulic motor 13 is operable to move the suspended load 15 in the same direction as a self-weight falling direction along which the suspended load 15 falls by its self-weight, that is, in a lowering direction, and in a direction opposite to the self-weight falling direction, that is, in a raising direction. Specifically, the hydraulic motor 13, having a first port 13*a* and a second port 13*b*, is operated in a rotational direction corresponding to the lowering direction by receiving a supply of hydraulic fluid to the first port 13*a* and discharging the hydraulic fluid from the second port 13*b* and operated in a rotational direction corresponding to the raising direction by receiving a supply of hydraulic fluid to the second port 13*b* and discharges the hydraulic fluid from the first port 13*a*

Figure 2:
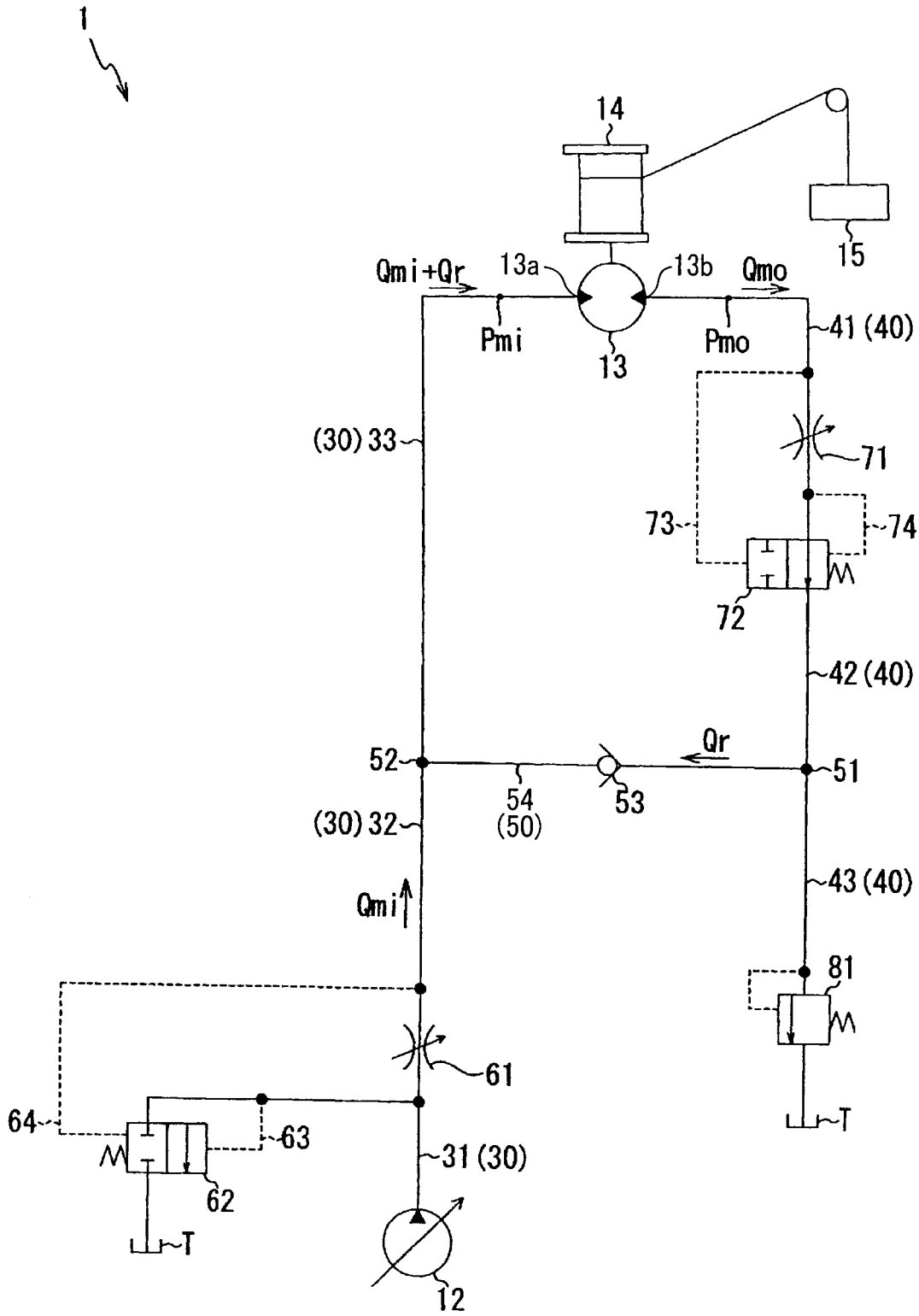
FIG. 2 is a circuit diagram for schematically explaining a function of the hydraulic driving apparatus shown in FIG. 1, during a lowering drive mode.

As shown in FIGS. 1 and 2, the hydraulic driving apparatus 1 has three hydraulic lines 31, 32 and 33 forming a meter-in fluid passage 30 on an upstream side of the hydraulic motor 13 during a lowering drive mode, three hydraulic lines 41, 42 and 43 forming a meter-out fluid passage 40 on a downstream side of the hydraulic motor 13 during the lowering drive mode, and a hydraulic line 54 forming a regeneration fluid passage 50 for communicating the meter-in fluid passage 30 with the meter-out fluid passage 40. The meter-in fluid passage 30 is provided with a meter-in flow control device, and the meter-out fluid passage 40 is provided with a meter-out flow control device and a back pressure valve 81. The meter-in flow control device includes a meter-in orifice 61 and a meter-in flow regulation valve 62; the meter-out flow control device includes a meter-out orifice 71 and a meter-out flow regulation valve 72.

The engine 11, as shown in FIG. 1, serves as a driving power source for the hydraulic pump 12. The invention permits the driving power source for the hydraulic pump 12 to be other device, for example, an electric motor. The hydraulic pump 12 supplies hydraulic fluid to the hydraulic motor 13 through the direction selector valve 20. The hydraulic pump 12, though being shown as a variable displacement type in FIG. 1, may be a fixed displacement hydraulic pump.

The hydraulic motor 13 is driven by hydraulic fluid supplied from the hydraulic pump 12 to move the suspended load 15. Specifically, the hydraulic motor 13 is coupled to a winch drum 14, and the load 15 is suspended by a cable wound around the winch drum 14. The hydraulic motor 13 is operable to rotate the winch drum 14 to thereby move the load 15 suspended by the cable upward and downward.

The "hydraulic actuator" in the present invention may be a hydraulic cylinder. Besides, the "load" is not limited to the suspended load 15. For example, the hydraulic driving apparatus of the present invention may be a type comprising a hydraulic cylinder operable to drive an attachment serving as a load, such as a boom, in a lowering direction identical to a self-weight falling direction of the attachment, and drive the attachment in a raising direction opposite to the self-weight falling direction.

The manipulation lever 16 serves as a manipulation member to be manually operated by an operator to designate a rotational direction and a rotational speed of the hydraulic motor 13. The remote-control valve 17 has a pair of output ports and outputs a pilot pressure having a value corresponding to an amount of the operation (operation amount) of the manipulation lever 16 from one of the output ports corresponding to an operation direction, that is, a direction of the operation of the manipulation lever 16. The output ports are connected to a lowering-side pilot port 20*a* and a raising-side pilot port 20*b* of the direction selector valve 20 through a lowering-side pilot line 28 and a raising-side pilot line 27, respectively, so that the pilot pressures output from the remote-control valve 17 are supplied to respective ones of the lowering-side pilot port 20*a* and the raising-side pilot port 20*b* through the lowering-side pilot line 28 and the raising-side pilot line 27, respectively.

The direction selector valve 20, which is disposed between a region including the first and second ports 13*a*, 13*b* of the hydraulic motor 13 and a region including the hydraulic pump 12 and a tank T, is operable to change the direction of the flow of the hydraulic fluid supplied from the hydraulic pump 12 to the hydraulic motor 13 and vary the flow rate thereof. Specifically, the direction selector valve 20 comprises a main spool adapted to be moved in a direction corresponding to a direction of a pilot pressure input into the direction selector valve 20, by a stroke corresponding to a value of the pilot pressure, being operable to lead the hydraulic fluid discharged from the hydraulic pump 12 toward the hydraulic motor 13 in a direction corresponding to a position of the main spool and at a flow rate corresponding to the stroke of the main spool.

Among the hydraulic lines 31 to 33 forming the meter-in fluid passage 30, the hydraulic line 31 connects the hydraulic pump 12 to a pump port provided in the direction selector valve 20; the hydraulic line 32 connects a first motor port of the direction selector valve 20 to a merging point 52 which is an interconnection point of the meter-in fluid passage 30 and the regeneration fluid passage 50; the hydraulic line 33 connects the merging point 52 to the first port 13*a* of the hydraulic motor 13. Besides, among the hydraulic lines 41 to 43 making up the meter-out fluid passage 40, the hydraulic line 41 connects the second port 13*b* of the hydraulic motor 13 to a second motor port of the direction selector valve 20; the hydraulic line 42 connects a first tank port of the direction selector valve 20 to a branching point 51 which is an interconnection point of the meter-out fluid passage 40 and the regeneration fluid passage 50; the hydraulic line 43 connects the branching point 51 to the tank T.

The direction selector valve 20 has a neutral position 21, a raising position 22 and a lowering position 23.

The neutral position 21 is a position for stopping the driving of the hydraulic motor 13. The direction selector valve 20 is held in the neutral position 21, when the manipulation lever 16 is in a neutral position, i.e., when the operation amount of the manipulation lever 16 is zero and no pilot pressure is supplied from the remote-control valve 17, to block between the hydraulic line 31 and the hydraulic line 32 while returning hydraulic fluid discharged from the hydraulic pump 12 to the tank T through the a bleed-off flow passage 26.

The raising position 22 is a position for driving the hydraulic motor 13 to move the suspended load 15 in the raising direction. The direction selector valve 20 is shifted to the raising position 22, when the manipulation lever 16 is manually operated in a direction for a raising drive mode, i.e., when a pilot pressure is supplied from the remote-control valve 17 to the raising-side pilot port 20*b* through the raising-side pilot line 27, to interconnect the hydraulic lines 31 and 41 and interconnect the hydraulic lines 32 and 42. The hydraulic fluid discharged from the hydraulic pump 12 is thereby supplied to the second port 13*b* of the hydraulic motor 13 through the hydraulic lines 31, 41 to drive the hydraulic motor 13 in the rotational direction corresponding to the raising direction, and returned from the first port 13*a* of the hydraulic motor 13 to the tank T through the hydraulic lines 33, 32, 42, 43.

The lowering position 23 is a position for driving the hydraulic motor 13 to move the suspended load 15 in the lowering direction. The direction selector valve 20 is shifted to the lowering position 23, when the manipulation lever 16 is manually operated in a direction for the lowering drive mode, i.e., when a pilot pressure is supplied from the remote-control valve 17 to the lowering-side pilot port 20*a* through the lowering-side pilot line 28, to interconnect the hydraulic lines 31 and 32 and interconnect the hydraulic lines 41 and 42. The hydraulic fluid discharged from the hydraulic pump 12 is thereby supplied to the first port 13*a* of the hydraulic motor 13 through the hydraulic lines 31, 33 to drive the hydraulic motor 13 in the rotational direction corresponding to the lowering direction, and returned from the second port 13*b* of the hydraulic motor 13 to the tank T through the hydraulic lines 41, 42, 43.

The direction selector valve 20 also has a throttle function, that is, has a valve opening degree which can vary depending on the operation amount of the manipulation lever 16. Specifically, the direction selector valve 20 is configured such that, the stroke of the main spool, i.e., a distance from the neutral position 21, becomes larger, as operation amount of the manipulation lever 16 and value of the pilot pressure corresponding to the operation amount is increased, thereby increasing a flow rate of hydraulic fluid to be supplied from the hydraulic pump 12 to the hydraulic motor 13 through the hydraulic line 32 (during the lowering drive mode) or the hydraulic line 41 (during the raising drive mode) to increase the rotational speed of the hydraulic motor 13, while reducing a flow rate of hydraulic fluid to be returned to the tank T through the bleed-off flow passage 26, that is, a bleed-off flow rate.

The meter-in fluid passage 30, through which hydraulic fluid is supplied from the hydraulic pump 12 to the hydraulic motor 13 when the direction selector valve 20 is shifted to the lowering position 23, is formed of the hydraulic line 31, an fluid passage within the direction selector valve 20 in the lowering position 23, the hydraulic line 32 and the hydraulic line 33. The meter-out fluid passage 40, through which hydraulic fluid is returned from the hydraulic motor 13 to the tank T when the direction selector valve 20 is shifted to the lowering position 23, is formed of the hydraulic line 41, an fluid passage within the direction selector valve 20 in the lowering position 23, the hydraulic line 42 and the hydraulic line 43. The following description about the hydraulic circuit in the first embodiment will be made on the assumption that the direction selector valve 20 is in the lowering position 23; FIG. 2 schematically shows a flow of hydraulic fluid during the lowering drive mode.

As shown in FIGS. 1 and 2, the regeneration fluid passage 50 is branched from the meter-out fluid passage 40 at the branching point 51, i.e., a position upstream of the back pressure valve 81 described in detail later, while merged with the meter-in fluid passage 30 at the merging point 52. The regeneration fluid passage 50 is provided with a check valve 53. The check valve 53 is adapted to permit hydraulic fluid only to flow in a direction from the branching point 51 of the meter-out fluid passage 40 to the merging point 52 of the meter-in fluid passage 30, to thus prevent hydraulic fluid from flowing from the meter-in fluid passage 30 into the meter-out fluid passage 40 bypassing the hydraulic motor 13.

Concerning the aforementioned throttle function, the direction selector valve 20 includes the meter-in orifice 61, the meter-out orifice 71, and further bleed-off orifice 21*a*. The bleed-off orifice 21*a* is to restrict the bleed-off flow rate, i.e., a flow rate of hydraulic fluid returned to the tank T through the bleed-off flow passage 26 bypassing the hydraulic motor 13, out of the hydraulic fluid discharged from the hydraulic pump 12.

The meter-in orifice 61 is provided in the meter-in fluid passage 30 to constitute the meter-in flow control device in cooperation with the meter-in flow regulation valve 62. The meter-in orifice 61 has a variable opening area, which becomes larger as the operation amount of the manipulation lever 16 and the value of the pilot pressure are increased. The meter-in orifice 61 may be provided outside the direction selector valve 20 independently thereof.

As shown in FIG. 2, the meter-in flow regulation valve 62 receives inputs of respective pressures on upstream and downstream sides of the meter-in orifice 61, and changes a flow rate in the meter-in fluid passage 30, specifically, a meter-in flow rate Qmi in a region of the meter-in fluid passage 30 upstream of the merging point 52, so as to keep a pressure difference between the two pressures, i.e., a inlet-outlet pressure difference of the meter-in orifice 61 at a predetermined constant set pressure difference ΔPmi. In detail, the meter-in flow regulation valve 62 is provided in a hydraulic line 65 branched from the mete-in fluid passage 30 at a position upstream of the merging point 52 (in FIG. 1, at a position upstream of the direction selector valve 20) and connected to the tank T, to change a flow rate of hydraulic fluid flowing in the hydraulic line 65. Into the meter-in flow regulation valve 62 are introduced two pilot pressures from upstream and downstream sides of the meter-in orifice 61 through pilot lines 63 and 64, respectively. The set pressure difference ΔPmi of the meter-in flow regulation valve 62 is set, for example, by means of a spring force. The valve opening degree of the meter-in flow regulation valve 62 is changed so as to make an inlet-outlet pressure difference of the meter-in orifice 61, that is, a difference between the two pilot pressures, be equal to the set pressure difference ΔPmi. Specifically, the valve opening degree of the meter-in flow regulation valve 62 is increased as the detected inlet-outlet pressure difference of the meter-in orifice 61 is increased to thereby increase a flow rate of hydraulic fluid to be returned to the tank T and reduce the meter-in flow rate Qmi, while reducing as the inlet-outlet pressure difference of the meter-in orifice 61 is decreased to thereby reduce the flow rate of hydraulic fluid to be returned to the tank T and increase the meter-in flow rate Qmi.

The meter-out orifice 71 is provided in the meter-out fluid passage 40 to constitute the meter-out flow control device in cooperation with the meter-out flow regulation valve 72. The meter-out orifice 71 has a variable opening area, which becomes larger as the operation amount of the manipulation lever 16 and value of the pilot pressure are increased. The meter-out orifice 71 also may be provided outside the direction selector valve 20 independently thereof.

As shown in FIG. 2, the meter-out flow regulation valve 72 receives inputs of respective pressures on upstream and downstream sides of the meter-out orifice 71, and changes a flow rate in the meter-out fluid passage 40, specifically, a meter-out flow rate Qmo in a region of the meter-out fluid passage 40 upstream of the branching point 51, so as to keep a difference between the two pressures, i.e., an inlet-outlet pressure difference of the meter-out orifice 71 at a predetermined constant set pressure difference ΔPmo. In detail, the meter-out flow regulation valve 72 is provided in the hydraulic line 42 at a position upstream of the branching point 51 to change a flow rate of hydraulic fluid flowing in the hydraulic line 42. Into the meter-out flow regulation valve 72 are introduced two pilot pressures from upstream and downstream sides of the meter-out orifice 71 through pilot lines 73, 74, respectively. The set pressure difference ΔPmo of the meter-out flow regulation valve 72 is set, for example, by means of a spring force. The valve opening degree of the meter-out flow regulation valve 72 is changed so as to make an inlet-outlet pressure of the meter-out orifice 71, i.e., a difference between the two pilot pressures, be equal to the set pressure difference ΔPmo. Specifically, the valve opening degree of the meter-out flow regulation valve 72 is reduced as the detected inlet-outlet pressure difference of the meter-out orifice 71 is increased to thereby reduce the meter-out flow rate Qmo, while increased as the inlet-outlet pressure difference of the meter-out orifice 71 is reduced to increase the meter-out flow rate Qmo.

Figure 16:
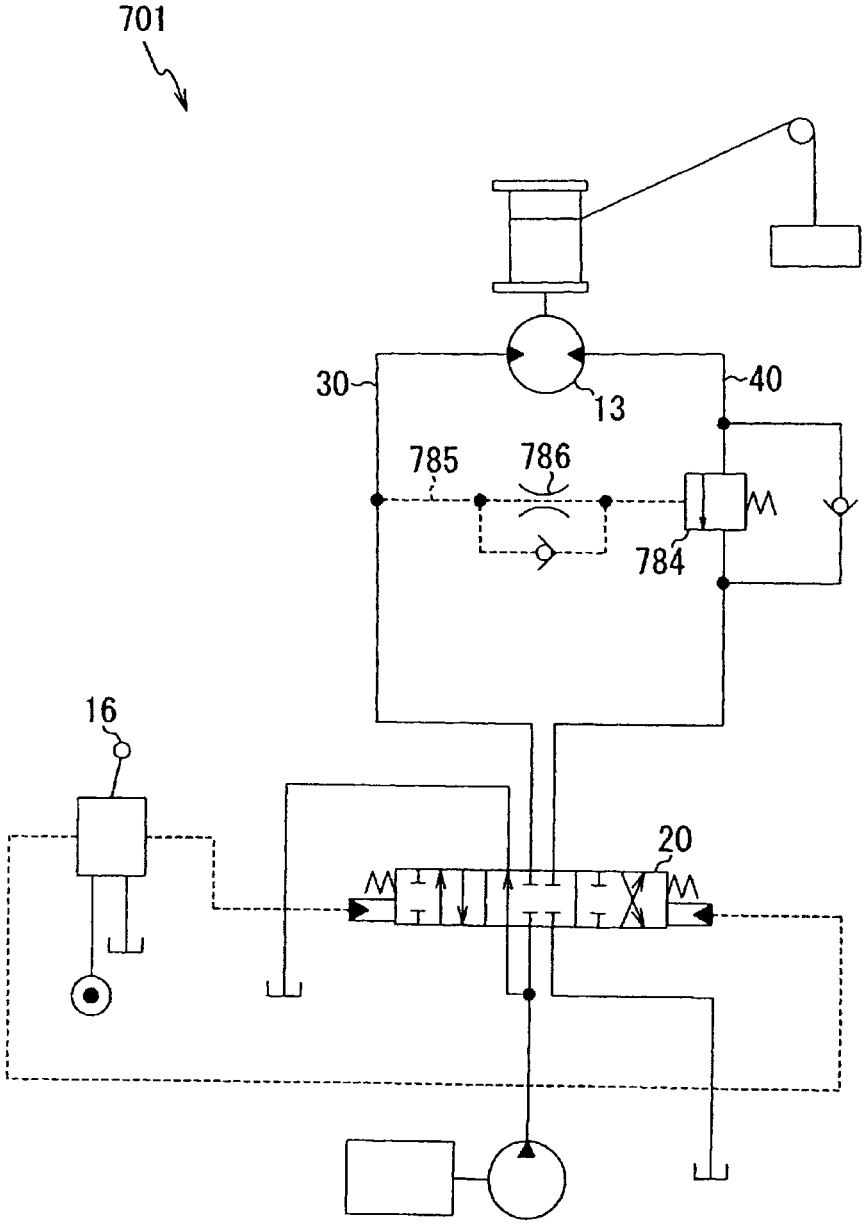
PRIOR ART FIG.16
FIG. 16 is a hydraulic circuit diagram showing a hydraulic driving apparatus provided in a conventional working machine.

The back pressure valve 81 is provided downstream of the meter-out orifice 71 and downstream of the meter-out flow regulation valve 72, to produce a set back pressure Pbk on an upstream side of the back pressure valve 81. The set back pressure Pbk is set to a constant pressure substantially equal to the set pressure P1 of the conventional external pilot-operated counterbalance valve 784 as shown in FIG. 16 (e.g., to about 1 MPa), for example, by means of a spring force. The back pressure valve 81 may be one having the same structure as that of a relief valve. In this case, the back pressure valve 81 is closed when a pressure upstream thereof is lower than the set back pressure Pbk, while opened when the pressure upstream thereof is greater than the set back pressure Pbk.

The structure of the back pressure valve 81 is not limited to that of a relief valve. The back pressure valve 81 may be, for example, an orifice having an opening area Abk which is increased as the operation amount of the manipulation lever 16 is increased. The opening area Abk may be set according to the following formula 1, wherein: Cv is a flow coefficient; ΔPbk is a pressure difference between the set back pressure Pbk and a pressure within the tank T (generally, atmospheric pressure); and Qbk is a flow rate of hydraulic fluid passing through the back pressure valve 81, being equal to the meter-in flow rate Qmi because of flow balance therebetween, if ignoring leakage of the hydraulic fluid from the hydraulic motor 13 and others.

$$Abk = \frac{Qbk}{Cv\sqrt{\Delta Pbk}} \quad \text{[Formula 1]}$$

There will be described a function of the hydraulic driving apparatus 1 according to the first embodiment.

The hydraulic driving apparatus 1 has a function of preventing cavitation in the meter-in fluid passage 30, as with the conventional external pilot-operated counterbalance valve 784 (see FIG. 16). Specifically, in order to prevent the cavitation, the meter-in pressure Pmi of the meter-in fluid passage 30 (a pressure downstream of the meter-in orifice 61, the pressure at an inlet of the hydraulic motor 13, or the respective pressures of the hydraulic lines 32, 33) is controlled so as not to be lower than a predetermined value. For this purpose, the working hydraulic driving apparatus 1 performs the following operations (1) to (4): (1) keeping a pressure on an upstream side of the back pressure valve 81 at the set back pressure Pbk (=pressure P1), that is, raising the pressure; (2) controlling the meter-out flow rate Qmo so as to make it greater than the meter-in flow rate Qmi; (3) causing hydraulic fluid to flow from the meter-out fluid passage 40 to the meter-in fluid passage 30 through the regeneration fluid passage 50; and (4) applying the pressure raised by the back pressure valve 81 to the meter-in fluid passage 30 to make the meter-in pressure Pmi be equal to the set back pressure Pbk of the back pressure valve 81. The details are as follows.

Firstly, the meter-out flow rate Qmo is controlled so as to be greater than the meter-in flow rate Qmi. Specifically, the valve opening degree of the meter-out flow regulation valve 72 and the valve opening degree of the meter-in flow regulation valve 62 are changed so as to satisfy the relation Qmo>Qmi. This control enables a regeneration flow rate Qr, that is, a flow rate of hydraulic fluid passing through the regeneration fluid passage 50, to be secured. More specifically, since the flow rate adsorbed by the hydraulic motor 13 and the flow rate discharged from the hydraulic motor 13 are equal to each other except leaked fluid, the hydraulic fluid flows from the meter-out fluid passage 40 into the meter-in fluid passage 30 through the regeneration fluid passage 50 in the regeneration flow rate Qr equivalent to a difference between the meter-out flow rate Qmo and the meter-in flow rate Qmi (Qmo−Qmi). In short, the meter-in flow rate and the meter-out flow rate are automatically balanced. Besides, since the pressure on the upstream side of the back pressure valve 91 is kept at the set back pressure Pbk of the back pressure valve 81 and the hydraulic fluid flows from the branching point 51 on the upstream side of the back pressure valve 81 to the meter-in fluid passage 30 through the regeneration fluid passage 50 (the regeneration flow rate Qr is secured), the meter-in pressure Pmi becomes equal to the set back pressure Pbk of the back pressure 81. This makes it possible to effectively suppress the occurrence of cavitation in the meter-in fluid passage 30.

Next will be more specifically described below the control of the meter-in flow rate Qmi and the meter-out flow rate Qmo.

The meter-in flow rate Qmi are controlled to satisfy the following formula 2, while the meter-out flow rate Qmo controlled to satisfy the following formula 3.

$$Qmi = Cv \times Ami \times \sqrt{\Delta Pmi} \quad \text{[Formula 2]}$$

$$Qmo = Cv \times Amo \times \sqrt{\Delta Pmo} \quad \text{[Formula 3]}$$

Figure 3:
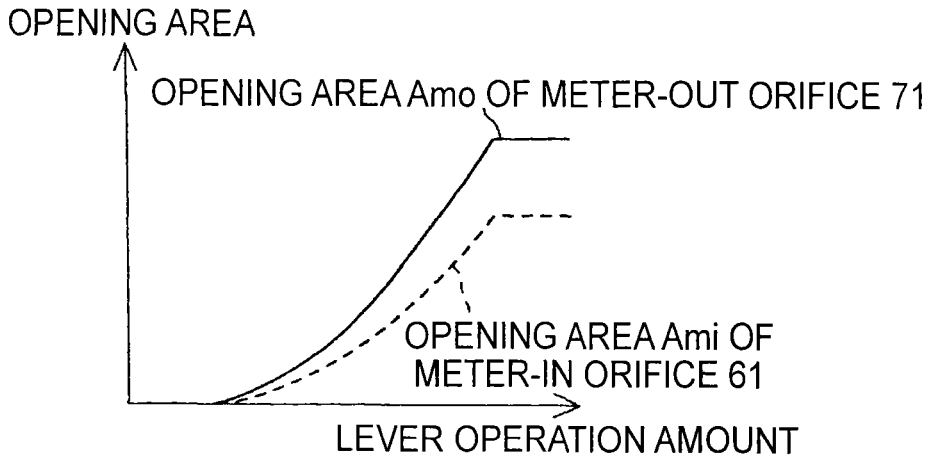
FIG. 3 is a graph showing a relationship between an opening area of each of a meter-in orifice and a meter-out orifice, and an operation amount of a manipulation lever.
Figure 4:
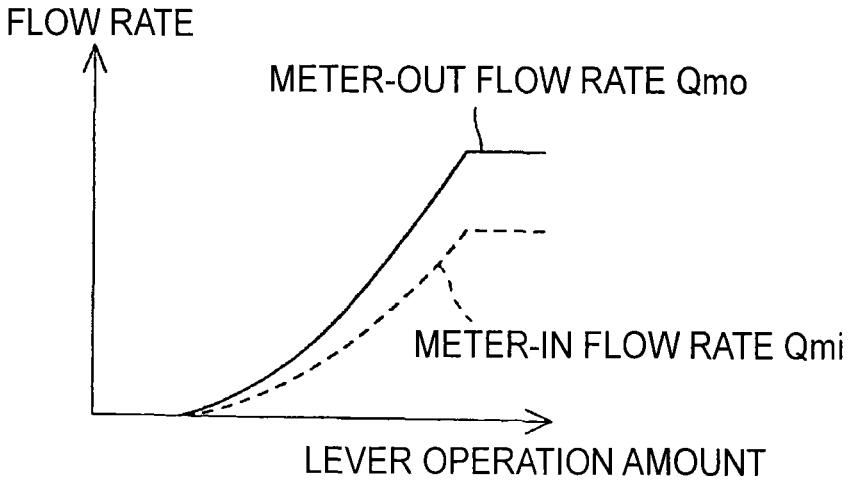
FIG. 4 is a graph showing a relationship between each of a meter-in flow rate and a meter-out flow rate, and the operation amount of the manipulation lever.

Cv is a flow coefficient. ΔPmi is an inlet-outlet pressure difference of the meter-in orifice 61 and a set pressure difference of the meter-in flow regulation valve 62. ΔPmo is an inlet-outlet pressure difference of the meter-out orifice 71 and a set pressure difference of the meter-out flow regulation valve 72. Ami is an opening area of the meter-in orifice 61. Amo is an opening area of the meter-out orifice 71. As shown in FIG. 3, each of the opening area Ami and the opening area Amo is increased and reduced according to a lever operation amount, that is, an operation amount of the manipulation lever 16. Consequently, as shown in FIG. 4, each of the meter-in flow rate Qmi and the meter-out flow rate Qmo is increased and reduced according to the lever operation amount. Specifically, each of the flow rates Qmi and Qmo becomes larger as the lever operation amount is increased.

The opening area Ami of the meter-in orifice 61 and the opening area Amo of the meter-out orifice 71 are adjusted so as to satisfy the condition for the flow rate control (Qmo>Qmi). For example, in the case where the set pressure difference ΔPmi (see the formula 2) and the set pressure difference ΔPmo (see the formula 3) are substantially equal to each other, the opening area Ami of the meter-in orifice 61 is set so as to be smaller than the opening area Amo of the meter-out orifice 71, as shown in FIG. 3. Specifically, the direction selector valve 20 is utilized to satisfy the above condition.

The meter-in flow rate Qmi can be also controlled by an adjustment of a discharge flow rate of the variable displacement hydraulic pump 12 shown in FIG. 2. Specifically, increasing a capacity of the hydraulic pump 12 as the lever operation amount becomes larger to increase the discharge flow rate of the hydraulic pump 12 makes it possible to increase the meter-in flow rate Qmi as the lever operation amount is increased, as shown in FIG. 4.

Figure 5:
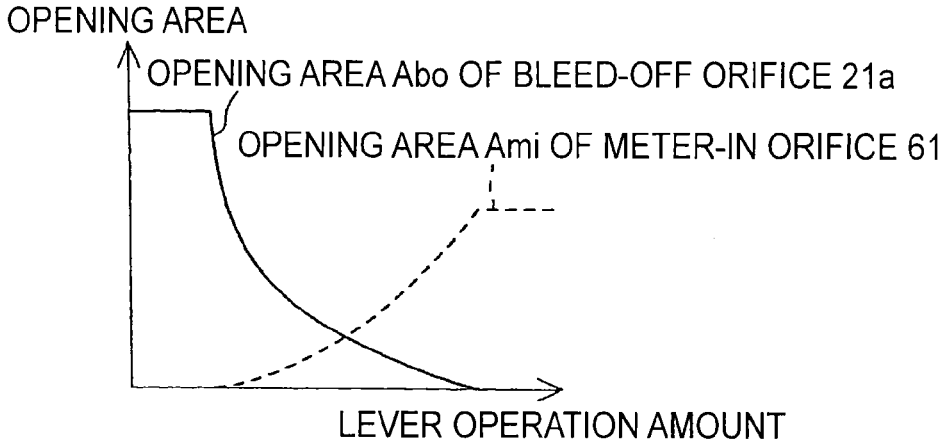
FIG. 5 is a graph showing a relationship between an opening area of each of a bleed-off orifice and the meter-in orifice, and the operation amount of the manipulation lever.

Alternatively, the meter-in flow rate Qmi may be controlled by changing an opening area Abo of the bleed-off orifice 21*a* shown in FIG. 1. In this case, the opening area Abo of the bleed-off orifice 21*a* is adjusted so as to reduce a flow rate of the hydraulic fluid to be returned from the hydraulic pump 12 to the tank T through the bleed-off flow passage 26 as the lever operation amount becomes larger. Specifically, reducing the opening area Abo as the lever operation amount becomes larger, as shown in FIG. 5, makes it possible to achieve the control of increasing the meter-in flow rate Qmi as the lever operation amount is increased.

In the above hydraulic driving apparatus 1, during the lowering drive mode for moving the suspended load 15 in the same direction as the self-weight falling direction, the hydraulic fluid flows from the branching point 51 on the upstream side of the back pressure valve 81 to the merging point 52 of the meter-in fluid passage 30 through the regeneration fluid passage 50 under the condition that a pressure in a region of the meter-out fluid passage 40 upstream of the back pressure valve 81 is kept at the set back pressure Pbk or more by the back pressure valve 81, so that the lowest value of the meter-in pressure Pmi which is a pressure of the meter-in fluid passage is guaranteed to be equal to or greater than the set back pressure Pbk of the back pressure 81. The cavitation in the meter-in fluid passage 30 is thus effectively suppressed. In addition, the meter-in flow control device and the meter-out flow control device control the meter-in flow rate Qmi and the meter-out flow rate Qmo so as to make the meter-out flow rate Qmo be greater than the meter-in flow rate Qmi, which allows the flow of hydraulic fluid from the meter-out fluid passage 40 to the meter-in fluid passage 30 through the regeneration fluid passage 50 to be reliably produced. In short, the regeneration flow rate Qr is secured.

Figure 17A:
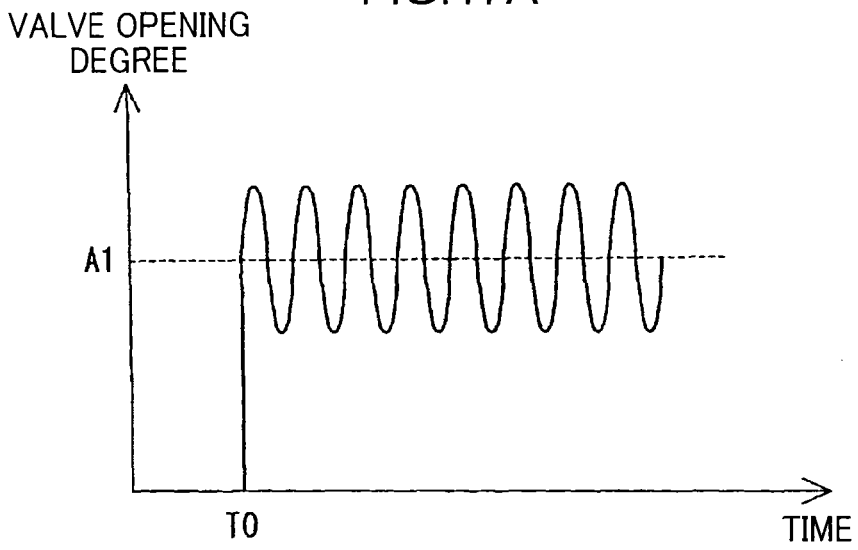
PRIOR ART FIG.17A
FIG. 17A is a graph showing hunting in opening degree of a counterbalance valve in the hydraulic driving apparatus shown in FIG. 16.
Figure 17B:
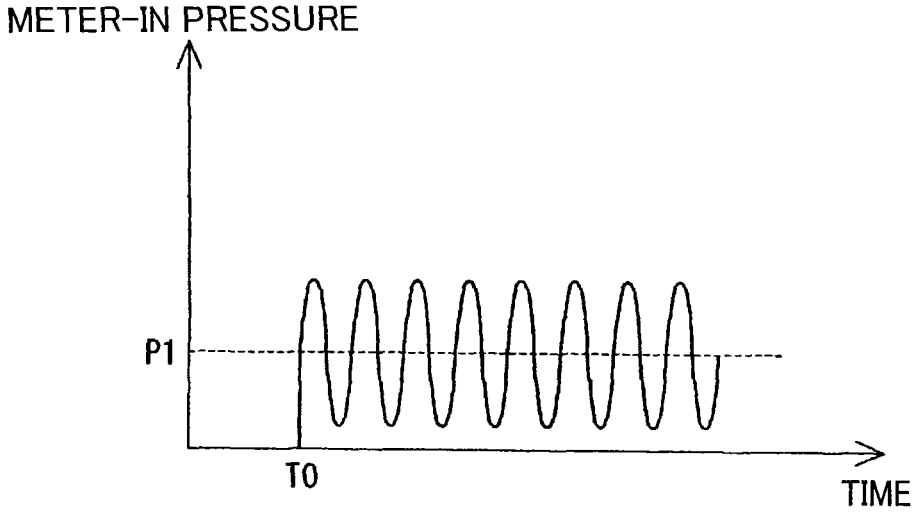
PRIOR ART FIG.17B
FIG. 17B is a graph showing hunting in meter-in pressure in the hydraulic driving apparatus shown in FIG. 16.

Since both of the measurement point and the control point of the meter-out flow regulation valve 72 are located on the meter-out fluid passage 40, co-location is control-theoretically established, differently from the conventional counterbalance valve in which a measurement point is located on a meter-in fluid passage while a control point is located on a meter-out fluid passage. Hence, hunting in valve opening degree of the meter-out flow regulation valve 72 and in pressure as shown in FIGS. 17A and 17B can be effectively suppressed. In other words, the hydraulic driving apparatus 1 enables cavitation in the meter-in fluid passage 30 to be suppressed with no use of a valve possibly causing a hunting in a valve opening degree or pressure, thereby suppressing hunting in rotational speed of the hydraulic motor 13.

Besides, no requirement of using such a valve as is likely to cause hunting in valve opening degree and pressure also eliminates necessity of taking anti-hunting measures, for example, gradually opening a valve (a meter-out flow regulation valve and a back pressure valve) provided in the meter-out fluid passage 40, when a pressure of the meter-in fluid passage 30 is increase, so as to allow a response of the valve to become moderate, as shown in FIG. 16. This makes it possible to suppress deterioration in valve response and deterioration in fuel economy due to the occurrence of an unnecessary boosted pressure (FIG. 18B), caused by the anti-hunting measures.

Figure 18A:
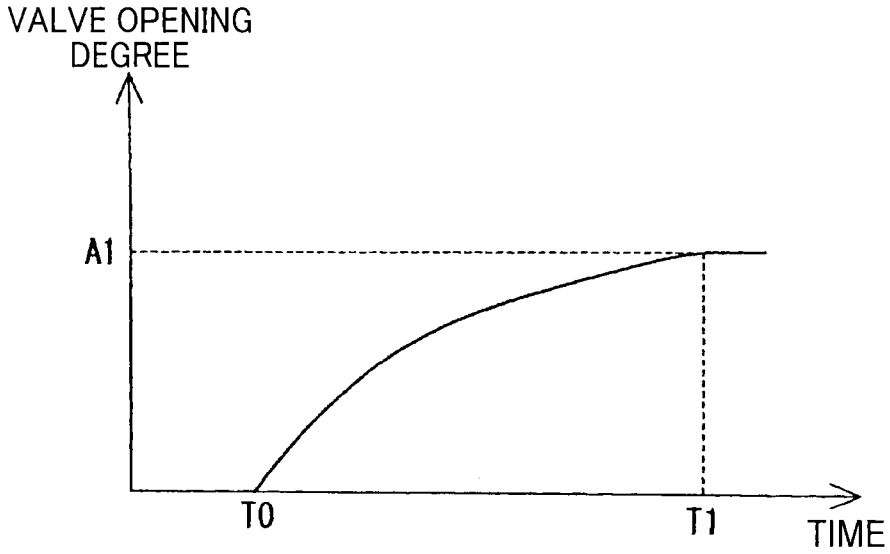
PRIOR ART FIG.18A
FIG. 18A is a graph showing a temporal change in opening degree of the counterbalance valve in the hydraulic driving apparatus shown in FIG. 16.
Figure 18B:
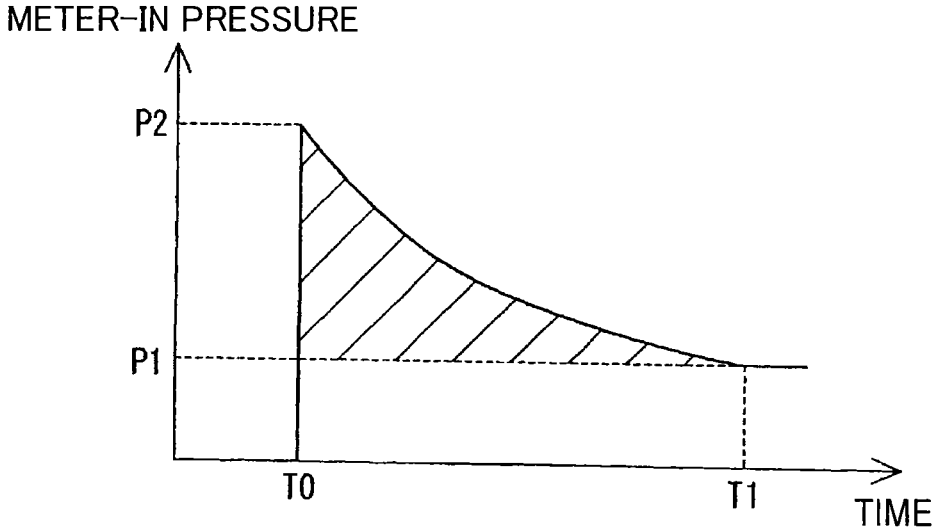
PRIOR ART FIG.18B
FIG. 18B is a graph showing a temporal change in meter-in pressure and boosted pressure in the hydraulic driving apparatus shown in FIG. 16.

Specifically, according to the conventional hydraulic driving apparatus 701 shown in FIG. 16, the orifice 786 is provided in the pilot line 785 of the external pilot-operated counterbalance valve 784 to suppress the aforementioned hunting, which causes the above-mentioned problem. For example, in the case where the manipulation lever 16 is manually operated from the neutral position toward a direction for the lowering, at the time TO shown in FIG. 18A, to start raising the meter-in pressure Pmi, the counterbalance valve 784 will be opened when the meter-in pressure Pmi reaches the set pressure P1 of the counterbalance valve 784; in this process, the function of the orifice 786 causes a long time (time period between T0 and T1) to be needed until the valve opening degree of the counterbalance valve 784 is increased to a desired valve opening degree, as shown in FIG. 18A. During this time period, the counterbalance valve 784 generates a pressure loss due to its flow resistance, which makes the meter-in pressure Pmi be greater than the set pressure P1 of the counterbalance valve 784, as shown in FIG. 18B. This means an occurrence of an unnecessary boosted pressure as indicated by the shaped region in FIG. 18B, which involves deterioration in fuel economy of the hydraulic driving apparatus 701 shown in FIG. 16.

Figure 6:
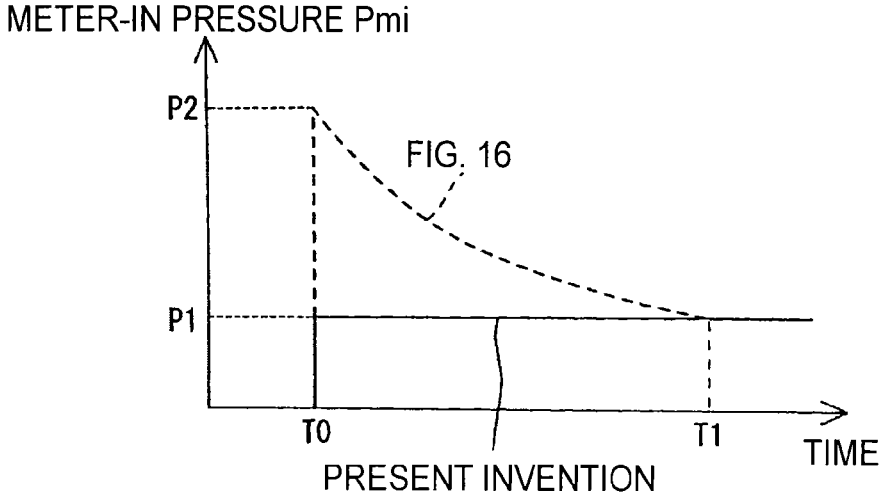
FIG. 6 is a graph showing a relationship between a meter-in pressure in the hydraulic driving apparatus, and time.
Figure 7:
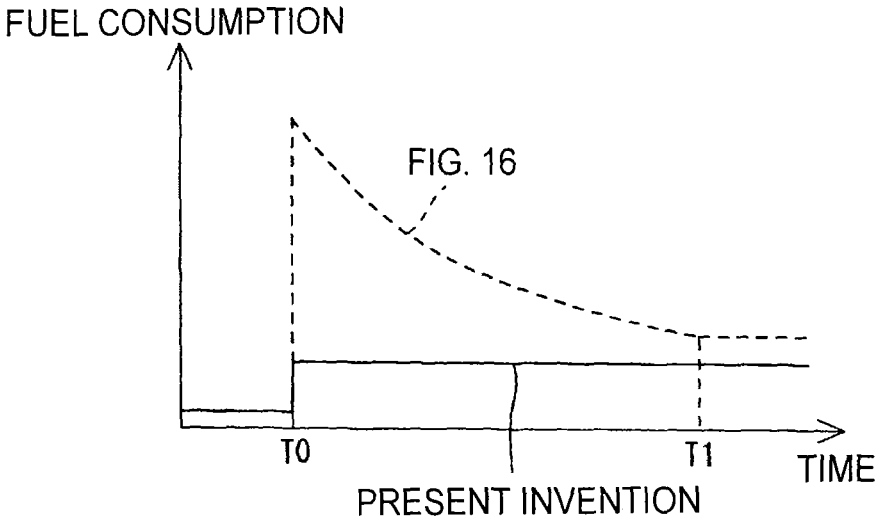
FIG. 7 is a graph showing a temporal change in fuel consumption of the hydraulic driving apparatus.

On contrary, the hydraulic driving apparatus 1 shown in FIG. 1, requiring no counterbalance valve which is likely to cause the aforementioned hunting, also has no requirement of the orifice 786 shown in FIG. 16. Hence, when the manipulation lever 16 is manually operated from the neutral position toward a position for the lowering, at the time TO in the same manner as above, the meter-in pressure Pmi quickly becomes equal to the set back pressure Pbk of the back pressure 81, as shown in FIG. 6. This allows the meter-in pressure Pmi to be significantly reduced during the time period between T0 and T1, as compared with the conventional apparatus. Since the power required for driving the hydraulic pump 12 shown in FIG. 1 is proportional to a product of a pressure and a flow rate of discharged fluid, the above reduction of the meter-in pressure Pmi effectively decreases the power required for driving the hydraulic pump 12 and the power of the engine 11 for driving the hydraulic pump 12. This makes it possible to significantly reduce fuel consumption of the engine 11 (for example, reduce the fuel consumption to about half between the time period between T0 and T1) as compared with the conventional apparatus, as shown in FIG. 7.

Besides, since the hydraulic motor 13 in the hydraulic driving apparatus 1 is supplied with the hydraulic fluid in a flow rate corresponding to the sum of the original meter-in flow rate Qmi and the regeneration flow rate Qr, the required discharge flow rate of the hydraulic pump 12 is reduced by an amount corresponding to the regeneration flow rate Qr, as compared with the case of lack of the regeneration fluid passage 50. Hence, the power required for driving the hydraulic pump 12 is reduced, and the fuel consumption of the engine 11 is reduced (see, particularly, a region after the time T1 in the graph shown in FIG. 7).

In addition, the hydraulic driving apparatus 1, where the speed of the hydraulic motor 13 is not changed if the lever operation amount is in the same condition, regardless of the change in the weight of the suspended load 15 shown in FIG. 1, allows high operability and safety to be ensured. Specifically, in the hydraulic driving apparatus 1, when the lever operation amount of the manipulation lever 16 is in the same condition, the valve opening degree (proportional to the opening area in the formula 3) of the meter-out orifice 71 is always kept constant, and the inlet-outlet pressure difference of the meter-out orifice 71 is kept at the constant set pressure difference ΔPmo (see the formula 3) by the meter-out flow regulation valve 72. Accordingly, the same lever operation amount generates the same meter-out flow rate Qmo (see the formula 3). This means that the problem of the change in speed of the hydraulic motor 13 depending on the level of weight of the suspended load 15 can be suppressed, resulting in the possibility of suppressing deterioration in operability and safety.

Furthermore, the meter-in flow regulation valve 62 of the hydraulic driving apparatus 1, which is adapted to adjust the flow rate Qmi of the meter-in fluid passage 30 so as to keep the inlet-outlet pressure difference of the meter-in orifice 61 at the constant set pressure difference ΔPmi, enables the meter-in flow rate Qmi to be reliably controlled.

Next will be described a second embodiment of the present invention, with reference to FIGS. 8 and 9.

Figure 8:
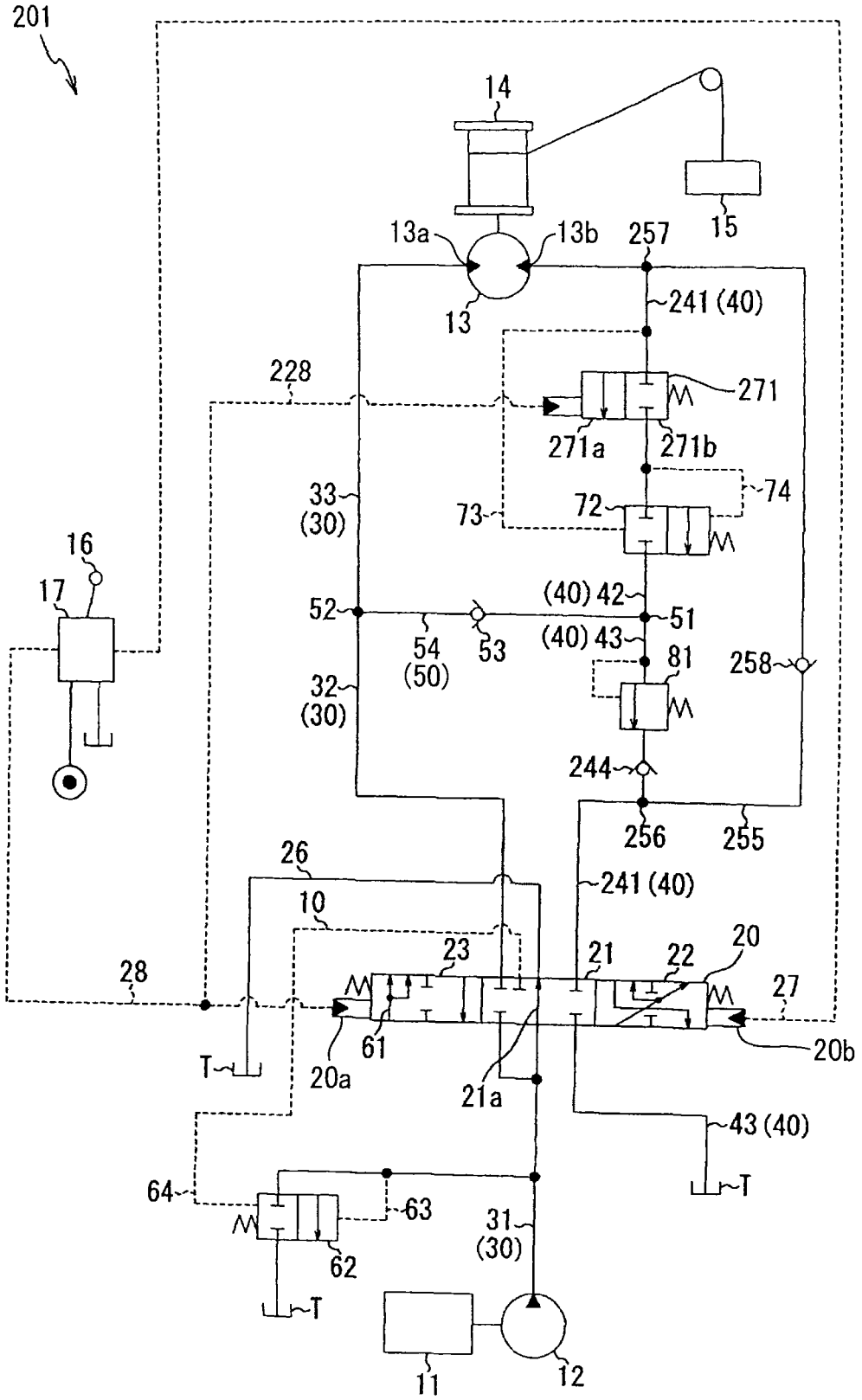
FIG. 8 is a circuit diagram showing a hydraulic driving apparatus, for a working machine, according to a second embodiment of the present invention.

FIG. 8 shows a hydraulic driving apparatus 201 according to the second embodiment. The hydraulic driving apparatus 201 comprises a meter-out flow regulation valve 72, a back pressure valve 81, and a meter-out valve 271 making up a meter-out orifice. While the working hydraulic driving apparatus 1 shown in FIG. 1 has the arrangement where the meter-out flow regulation valve 72 and the back pressure valve 81 are provided downstream of the direction selector valve 20 and the meter-out orifice 71 consists of a part of the direction selector valve 20, the meter-out valve 271 (meter-out orifice), the meter-out flow regulation valve 72 and the back pressure valve 81 shown in FIG. 8 are provided upstream of a direction selector valve 20. The hydraulic driving apparatus 201 further comprises a hydraulic line 241 interconnecting the hydraulic motor 13 and the direction selector valve 20, and the meter-out valve 271, the meter-out flow regulation valve 72 and the back pressure valve 81 are provided in the hydraulic line 241. Furthermore, a bypass fluid passage 255 for raising is provided to the hydraulic line 241 in parallel therewith.

The difference between the second embodiment and the first embodiment is more specifically described below.

The bypass fluid passage 255 for raising is to supply the hydraulic fluid from the hydraulic pump 12 to the hydraulic motor 13, bypassing the meter-out valve 271, the meter-out flow regulation valve 72 and the back pressure valve 81, during the raising drive mode in which the direction selector valve 20 is shifted to the raising position 22. The bypass fluid passage 255 for raising is branched from the hydraulic line 241 and merged with the hydraulic line 242, at a branching point 256 and at a merging point 257 on both sides of a group of the valves 271, 72, 81, respectively. The bypass fluid passage 255 for raising is provided with a check valve 258 permitting the hydraulic fluid to flow only in a direction from the branching point 256 to the merging point 257; between the branching point 256 and the back pressure valve 81 is provided a check valve 244 permitting the hydraulic fluid to flow only in a direction from the merging point 257 to the branching point 256.

When the manipulation lever 16 is manually operated in the direction for the lowering drive mode to shift the direction selector valve 20 to the lowering position 23, the check valves 244, 258 enable the hydraulic fluid to be supplied from the hydraulic pump 12 to the first port 13*a* of the hydraulic motor 13 through the hydraulic lines 31, 32 and 33 and the hydraulic fluid discharged from the second port 13*b* of the hydraulic motor 13 is returned to the tank T through the meter-out valve 271, the meter-out flow regulation valve 72 and the back pressure valve 81.

The following description will be made on the basis of the lowering drive mode. The meter-out valve 271, which is provided separately from the direction selector valve 20 and has the same function as that of the meter-out orifice 71 (FIG. 2), is supplied with the pilot pressure for lowering output from the remote-control valve 17, for example, through a pilot line 228 branched from the lowering-side pilot line 28. The meter-out valve 271 has a lowering position 271*a* and a non-lowering position 271*b*, and is configured to be moved from the non-lowering position 271*b* toward the lowering position 271*a* along with an increase in the pilot pressure. This increases an opening area of the meter-out valve 271.

In the hydraulic driving apparatus 201, when the operation amount of the manipulation lever 16, i.e., the lever operation amount, is zero, the direction selector valve 20 is held in the neutral position 21, and the meter-out valve 271 is held in the non-lowering position 271*b*. When the manipulation lever 16 is manually operated from the neutral position in the direction for the lowering drive mode, the pilot pressure is generated in the lowering-side pilot line 28 and the pilot line 228 to shift the direction selector valve 20 to the lowering position 23 and shift the meter-out valve 271 to the lowering position 271*a*.

Figure 9:
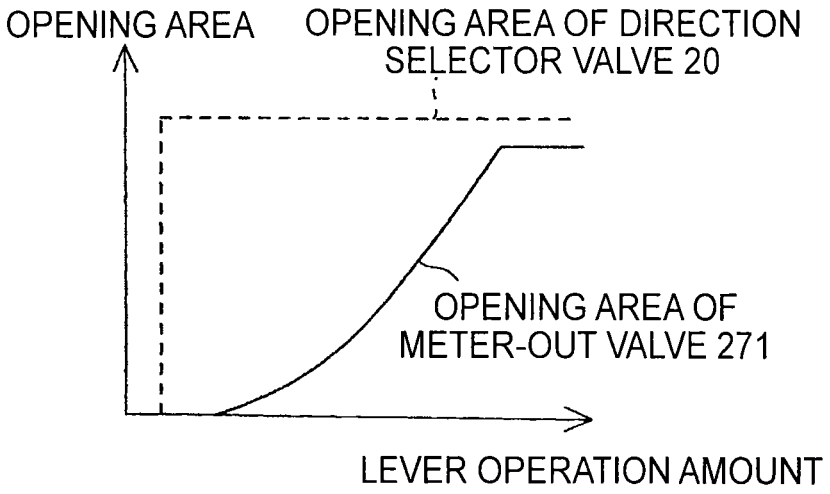
FIG. 9 is a graph showing a relationship between an opening area of each of a direction selector valve and a meter-out valve, and an operation amount of a manipulation lever.

FIG. 9 shows a relationship between the lever operation amount and each of the opening areas of the meter-out valve 271 and the direction selector valve 20. The meter-out valve 271 is moved toward the lowering position, along with an increase in the lever operation amount, to increase the valve opening degree (opening area) thereof, while the direction selector valve 20 is fully opened immediately after the operation of the manipulation lever 16 in the direction for the lowering drive mode. Thus, not the direction selector valve 20 but the meter-out valve 271 dominates the control of the meter-out flow rate Qmo during the lowering drive mode.

In the hydraulic driving apparatus 201, locating both of the meter-out valve 271 and the meter-out flow regulation valve 72 upstream of the direction selector valve 20 allows the distance between the hydraulic motor 13 and each of the meter-out valve 271 and the meter-out flow regulation valve 72 to be less than that between the hydraulic motor 13 and the direction selector valve 20. This means that the meter-out valve 271 and the meter-out flow regulation valve 72 dominating the control of the meter-out flow rate Qmo in the above manner can be disposed near the hydraulic motor 13. This makes it possible to suppress deterioration in response to manipulation of the operating speed of the hydraulic motor 13.

The detail of this point is as follows. There is provided a hydraulic piping between the hydraulic motor 13 and the direction selector valve 20, and the length of the piping is often set great for the arrangement of some devices. Accordingly, providing the meter-out orifice 71 and the meter-out flow regulation valve 72 inside or downstream of the direction selector valve 20 as the hydraulic driving apparatus 1 shown in FIG. 1 may require the hydraulic piping between the hydraulic motor 13 and each of the meter-out orifice 71 and the meter-out flow regulation valve 72 to be long. This causes the possibility of deteriorating response between respective ones of a series of actions: operating the manipulation lever 16 in the direction for the lowering drive mode; controlling the meter-out flow rate by the meter-out orifice 71 and the meter-out flow regulation valve 72; and controlling the rotational speed of the hydraulic motor 13. In contrast, the working hydraulic driving apparatus 201 shown in FIG. 8 allows the length of the hydraulic piping between the hydraulic motor 13 and each of the meter-out valve 271 and the meter-out flow regulation valve 72 to be short, thereby producing the possibility of improving the response.

Next will be described a third embodiment of the present invention with reference to FIGS. 10 and 11.

Figure 10:
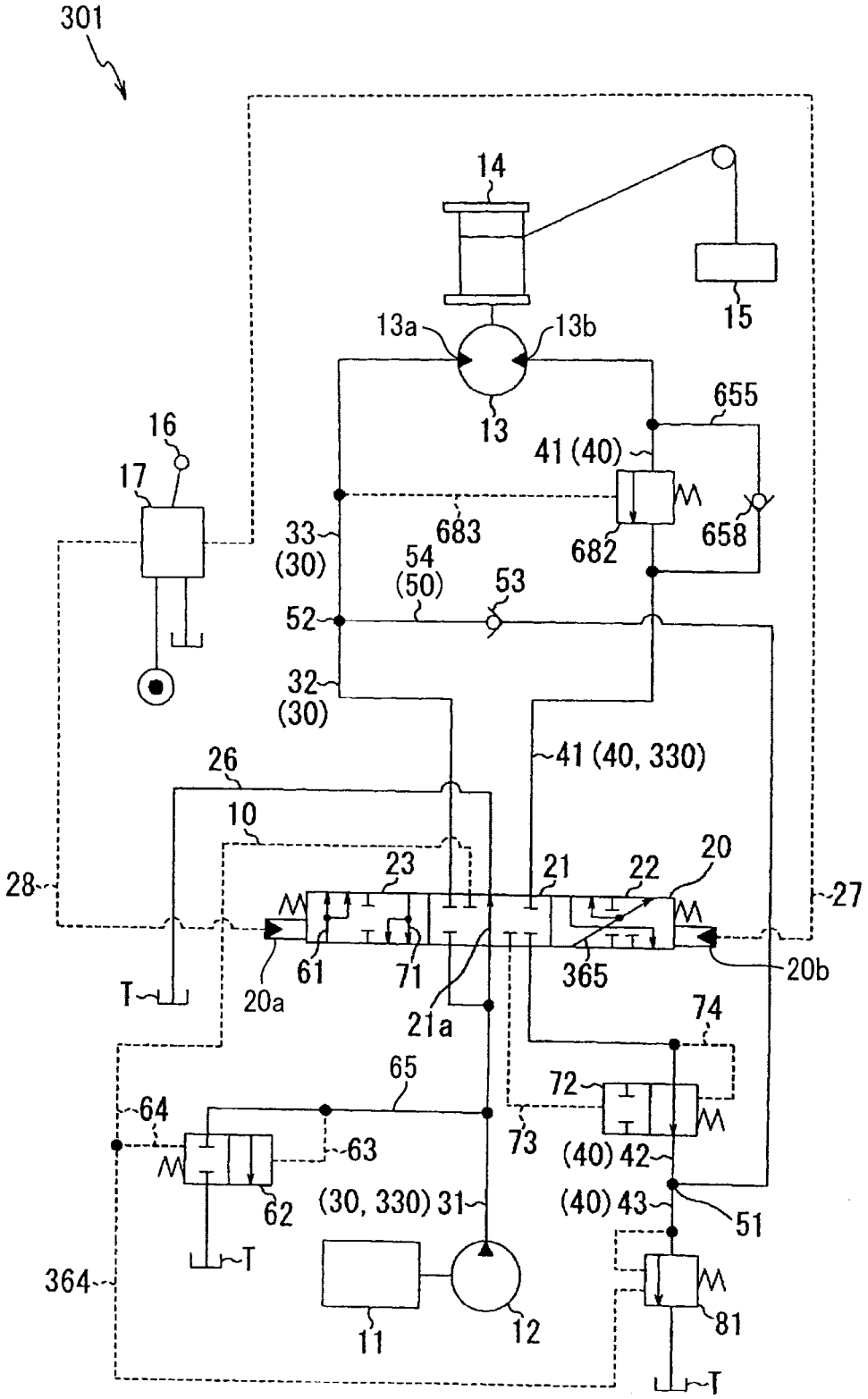
FIG. 10 is a circuit diagram showing a hydraulic driving apparatus, for a working machine, according to a third embodiment of the present invention.

FIG. 10 shows a hydraulic driving apparatus 301 according to the third embodiment. The hydraulic driving apparatus 301 comprises a safety-ensuring pressure control valve 682 as a component which is not shown in FIG. 1: the details thereof will be described later.

Figure 11:
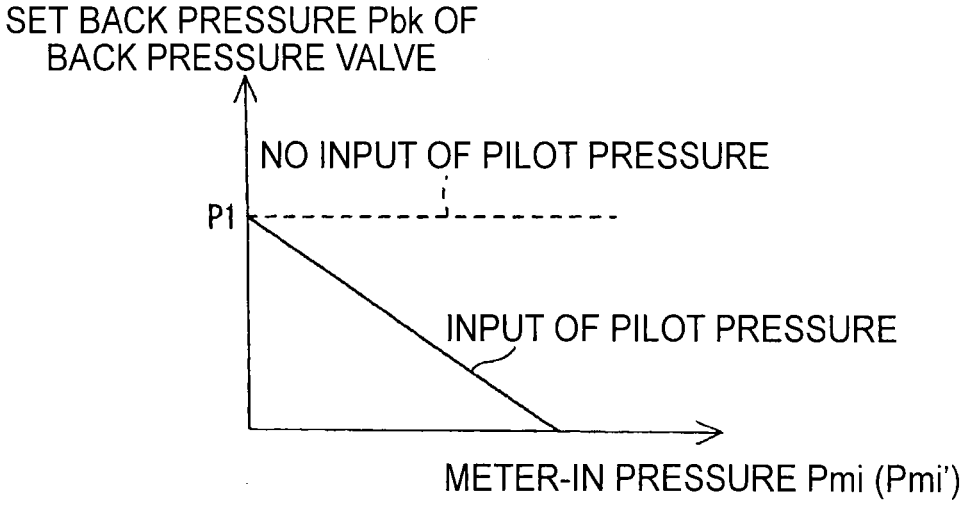
FIG. 11 is a graph showing a relationship between a set back pressure of a back pressure valve shown in FIG. 10 and a meter-in pressure.

While the set back pressure Pbk of the back pressure valve 81 in the working hydraulic driving apparatus 1 shown in FIG. 1 is set to the constant value P1 by means of a spring or the like, the set back pressure Pbk, in the working hydraulic driving apparatus 301 shown in FIG. 10, is reduced, under a given condition, from the maximum value P1 as shown in FIG. 11, that is, the valve opening degree of the back pressure valve 81 is increased, along with an increase in the meter-in pressure Pmi. This difference is described in the following.

The working hydraulic driving apparatus 301 has a meter-in fluid passage 330 for raising, which is to supply hydraulic fluid from the hydraulic pump 12 to the hydraulic motor 13 therethrough when the direction selector valve 20 is shifted to the raising position 22. The raising meter-in fluid passage 330 is formed of the hydraulic line 31, the fluid passage within the direction selector valve 20 in the raising position 22, and the hydraulic line 41. The direction selector valve 20 includes a meter-in orifice 365 for raising, in the raising position 22. Similarly to the lowering meter-in orifice 61, the raising meter-in orifice 365 has a variable opening area which is changed according to the lever operation amount of the manipulation lever 16.

There is connected a pilot line 364 to the back pressure valve 81. The pilot line 364 is equivalent to a back pressure valve operating section which increases an opening degree of the back pressure valve 81 under a given condition, as described in detail later. The pilot line 364 is branched from the meter-in fluid passage 30 at a position downstream of the meter-in orifice 61 within the direction selector valve 20 in the lowering position 23, and, during the lowering drive mode, leads the meter-in pressure Pmi to the back pressure valve 81 as a pilot pressure. The meter-in pressure Pmi' during the raising drive mode is a pressure of a region of the raising meter-in fluid passage 330 downstream of the raising meter-in orifice 365 (a pressure at an inlet of the hydraulic motor 13 during the raising drive mode, a pressure of the hydraulic line 41 during the raising drive mode). The pilot line 364 is branched from the raising meter-in fluid passage 330 at a position downstream of the raising meter-in orifice 365 in the raising position 22 of the direction selector valve 20.

Next will be described an action of the hydraulic driving apparatus 301.

The increase in the meter-in pressure Pmi during the lowering drive mode reduces the set back pressure Pbk of the back pressure valve 81 to thereby increase the valve opening degree of the back pressure valve 81. During a normal lowering drive mode (the normal-load lowering drive mode), the meter-in pressure Pmi is maintained constant at the set back pressure Pbk of the back pressure valve 81 (=the pressure P1) and thus not raised, as mentioned above; however, when the hydraulic motor 13 is moved in a rotational direction corresponding to the lowering direction in a state of lack of the suspended load 15 (with empty hook), that is, when the no-load lowering is performed, there is a possibility of a rise in the meter-in pressure. In detail, during the no-load lowering drive mode, the self-weight of the suspended load 15 does not act on the hydraulic motor 13 and thus produces no holding pressure in the meter-out fluid passage 40. Besides, for driving the hydraulic motor 13, the meter-in pressure Pmi is greater than the meter-out pressure Pmo. Accordingly, the check valve 53 in the regeneration fluid passage 50 prevents hydraulic fluid from flowing through the regeneration fluid passage 50. The meter-in pressure Pmi is therefore equal to or greater than at least the maximum value (=the pressure P1) of the set back pressure Pbk of the back pressure valve 81. In other words, the meter-in pressure Pmi becomes equal to or greater than a pressure on an upstream side of the meter-out flow regulation valve 72 and a pressure on an upstream side of the meter-out orifice 71. The meter-in pressure Pmi is raised or reduced depending on a discharge pressure of the hydraulic motor 13 and an operation of the meter-in orifice 61.

In not only the case of lowering without the suspended load 15, but also the case of lowering a suspended load which is light enough to fail to produce a holding pressure in the meter-out fluid passage 40, there is a possibility of a rise in the meter-in pressure Pmi.

The rise in the meter-in pressure Pmi increases the valve opening degree of the back pressure valve 81. Specifically, the raised meter-in pressure Pmi is input into the back pressure valve 81 through the pilot line 364 as a pilot pressure, thereby pushing back the spring which determines the set back pressure Pbk of the back pressure valve 81, to reduce the set back pressure Pbk of the back pressure valve 81. FIG. 11, which shows a relationship between the set back pressure Pbk of the back pressure valve 81 and the meter-in pressure Pmi, teaches that the increase in the meter-in pressure Pmi reduces (in this figure, proportionally reduces) the set back pressure Pbk. The relationship between the set back pressure Pbk and the meter-in pressure Pmi is able to be appropriately changed.

On the other hand, during the raising drive mode, i.e., when the hydraulic motor 13 is driven to move the suspended load 15 in a direction opposite to the self-weight falling direction, there is performed a control for increasing the valve opening degree of the back pressure valve 81. Specifically, corresponding to respective operations of the hydraulic pump 12 and the raising meter-in orifice 365, the pressure of the hydraulic line 41 of the raising meter-in fluid passage 330 (the meter-in pressure Pmi' during the raising drive mode) is raised, and the thus raised meter-in pressure Pmi' is input into the back pressure valve 81 through the pilot line 364 as a pilot pressure, thereby increasing the valve opening degree of the back pressure valve 81 similarly to the no-load lowering drive mode. The relationship between the set back pressure Pbk and the meter-in pressure Pmi' during the raising drive mode may be, for example, the same as the relationship between the set back pressure Pbk and the meter-in pressure Pmi during the lowering drive mode (see FIG. 11), or may be different therefrom. In the case where no hydraulic fluid passes through the back pressure valve 81 during the raising drive mode as in the hydraulic driving apparatus 201 shown in FIG. 8, it is not necessary to reduce the set back pressure Pbk of the back pressure valve 81 during the raising drive mode.

In the hydraulic driving apparatus 301, respective upstream and downstream pressures of the hydraulic motor 13 are kept so high, in both of the cases (a) where the pressure of the meter-in fluid passage 30 is raised during the lowering drive mode and a situation and (b) where the hydraulic motor 13 is driven to move the suspended load 15 in a direction opposite to the self-weight falling direction, that cavitation can be prevented. Furthermore, in both of the cases (a) and (b), the valve opening degree of the back pressure valve 81 is increased to thereby reduce the pressures at respective positions upstream and downstream of the hydraulic motor 13. This makes it possible to suppress the rise in the pressures at the upstream and downstream positions of the hydraulic motor 13 due to the pressure loss in the back pressure 81 and suppress deterioration in fuel economy of the engine 11 due to an increase in driving power for the hydraulic pump 12.

The above effects will be more specifically described below. During the normal-load lowering drive mode, the self-weight of the suspended load 15 rotates the hydraulic motor 13 to thus reduce the meter-in pressure Pmi, which generates the possibility of the cavitation problem; however, in the case (b), driving the hydraulic motor 13 by supplying the hydraulic fluid thereto ensures the pressures at the upstream and downstream position of the hydraulic motor to be kept high enough to prevent the above cavitation from occurring. Similarly, in the case (a) of the no-load lowering, the cavitation problem in the meter-in fluid passage 30 fails to occur, as mentioned above. In the cases (a) and (b) where the cavitation problem thus fails to occurs, keeping the valve opening degree of the back pressure valve 81 a relatively small value would unnecessarily raise a circuit pressure. Specifically, the small valve opening degree raises respective pressures of the meter-in fluid passage 30 and the meter-out fluid passage 40 during the lowering drive mode, while raising respective pressures of the hydraulic lines 31, 41, 33, 32, 42, 43 during the raising drive mode. These result in an increased driving power for the hydraulic pump 12 and deteriorated fuel economy of the engine 11. The hydraulic driving apparatus 301, however, allows the valve opening degree of the back pressure valve 81 to be increased in a situation where the cavitation problem never occurs, thereby making it possible to suppress deterioration in fuel economy.

Next will be described a fourth embodiment of the present invention, with reference to FIGS. 12 to 14.

Figure 12:
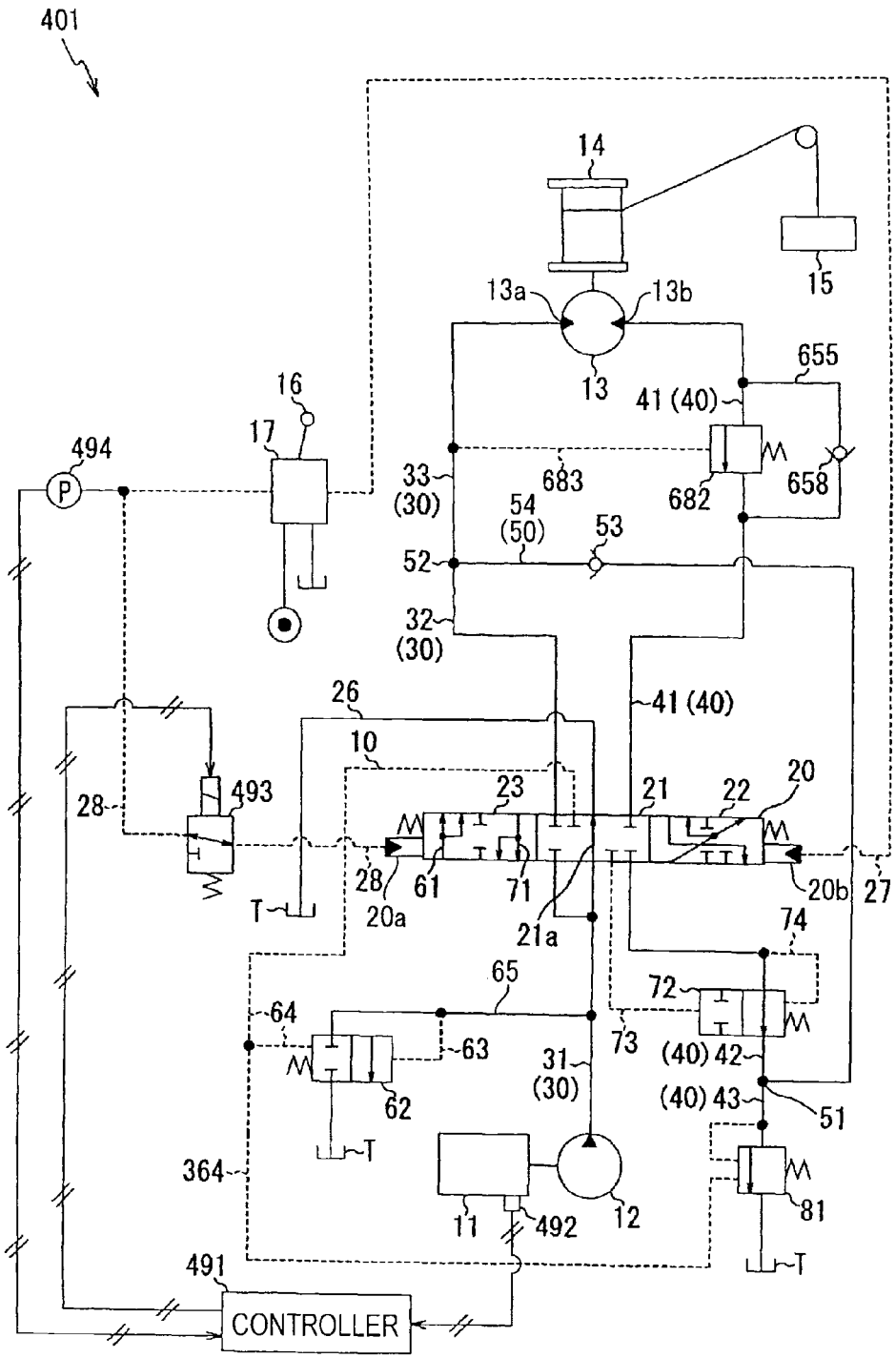
FIG. 12 is a circuit diagram showing a hydraulic driving apparatus, for a working machine, according to a fourth embodiment of the present invention.

FIG. 12 shows a hydraulic driving apparatus 401 according to the fourth embodiment. The difference between the hydraulic driving apparatus 401 and the working hydraulic driving apparatus 1 shown in FIG. 1 is as follows.

The hydraulic driving apparatus 401 shown in FIG. 12 comprises a controller 491 composed of a computer and others, and various devices connected to the controller 491: specifically, an engine speed sensor 492, a solenoid-operated pressure reducing valve 493 and a pilot pressure sensor 494. The controller 491 is designed to perform a control operation for reducing the valve opening degree of the meter-out orifice 71 when the rotational speed (engine speed) of the engine 11 is reduced. The engine speed sensor 492 is to detect the rotational speed of the engine 11; instead of this, other sensors for detecting the rotational speed of the hydraulic pump 12 may be provided. The solenoid-operated pressure reducing valve 493 is provided in the lowering-side pilot line 28 to reduce the pilot pressure for lowering output from the remote-control valve 17, i.e., a pilot pressure in a region of the lowering-side pilot line 28 on a side adjacent to the remote-control valve 17 with respect to the solenoid-operated pressure reducing valve 493 (on an inlet side of the solenoid-operated pressure reducing valve 493). The pilot pressure sensor 494 is to detect the pilot pressure for lowering.

In the hydraulic driving apparatus 401, when the rotational speed of the engine 11 as a driving power source for the hydraulic pump 12 or the rotational speed of the hydraulic pump 12 is reduced, the controller 491 operates the solenoid-operated pressure reducing valve 493 so as to reduce the valve opening degree of the meter-out orifice 71 (proportional to the opening area Amo in the formula 3), thereby reducing the meter-out flow rate Qmo (see the formula 3) and the rotational speed of the hydraulic motor 13. Specifically, the controller 491 inputs an electric control signal so as to make an outlet pressure of the solenoid-operated pressure reducing valve 493 (a pressure on the side of a direction selector valve 20) be lower than the pilot pressure for lowering detected by the pilot pressure sensor 494. The pilot pressure to be input into the direction selector valve 20 is thereby reduced, which makes the direction selector valve 20 be closer to the neutral position 21, reducing the valve opening degree of the meter-out orifice 71 and further the valve opening degree of the meter-in orifice 61 each included in the direction selector valve 20. In other words, the hydraulic driving apparatus 401 operates as if the manipulation lever 16 is manually operated in a direction toward the neutral position, i.e., the lever operation amount is reduced to reduce the rotational speed of the hydraulic motor 13. Conversely, when the rotational speed of the engine 11 is increased, the valve opening degree of the meter-out orifice 71 is increased to thereby increase the rotational speed of the hydraulic motor 13.

Figure 13:
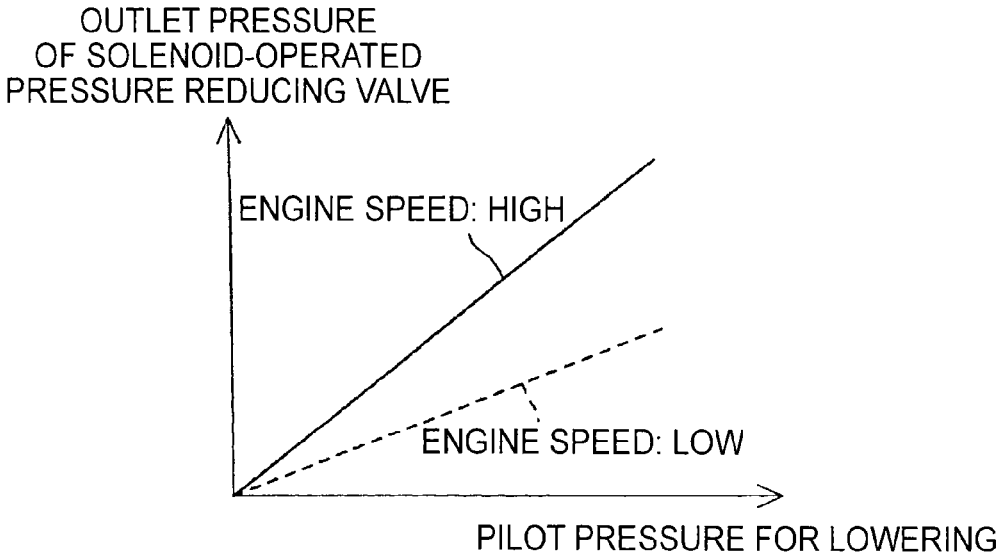
FIG. 13 is a graph showing a relationship between a secondary pressure of a solenoid-operated pressure reducing valve and a lowering driving pilot pressure.

FIG. 13 shows a relationship between the pilot pressure for lowering and the secondary pressure of the solenoid-operated pressure reducing valve 493. The controller 491 shown in FIG. 12 is adapted to operate the solenoid-operated pressure reducing valve 493 so as to make a degree of the pressure reduction by the solenoid-operated pressure reducing valve 493 be larger along with (in the example shown in FIG. 13, in proportion to) the reduction in the engine speed.

Figure 14:
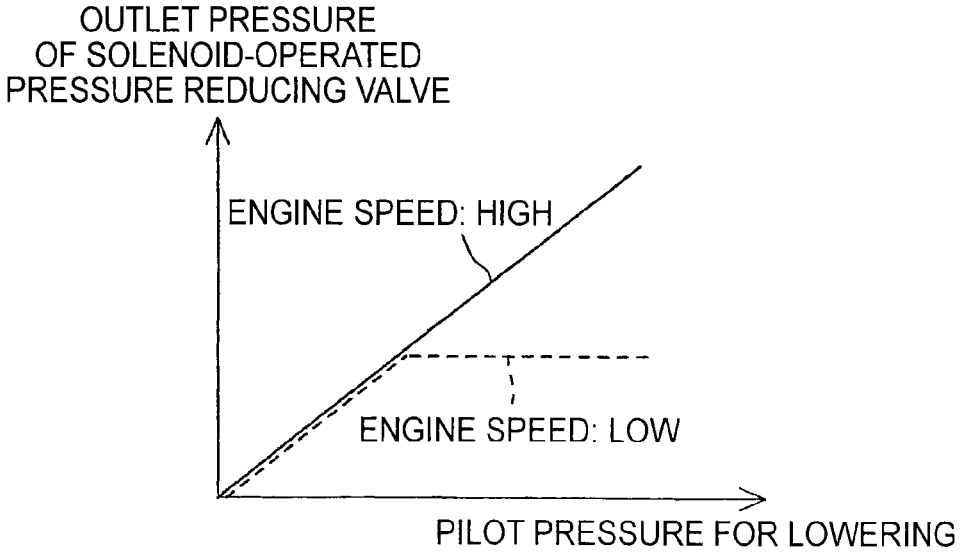
FIG. 14 is a graph showing an example of modification of the relationship shown in FIG. 13.

FIG. 14 shows an example of modification of the relationship between the pilot pressure for lowering and the outlet pressure of the solenoid-operated pressure reducing valve 493. As shown in this figure, the controller 491 may keep an outlet pressure of the solenoid-operated pressure reducing valve 493 to a constant pressure, in the case of low engine speed, when the pilot pressure for lowering is equal to or greater than a predetermined value or more, and inhibit the solenoid-operated pressure reducing valve 493 from performing the pressure reduction when the pilot pressure for lowering is lower than the predetermined value. Besides, the relationship between the pilot pressure for lowering and the outlet pressure of the solenoid-operated pressure reducing valve 493 may be appropriately changed.

In the hydraulic driving apparatus 401, as mentioned above, the controller 491 reduces the valve opening degree of the meter-out orifice 71 (proportional to the opening area Amo in the formula 3), when the rotational speed of the engine 11 as a driving power source for the hydraulic pump 12 or the rotational speed of the hydraulic pump 12 is reduced, thereby reducing the flow rate Qmo in the meter-out fluid passage 40 (see the formula 3) and the rotational speed of the hydraulic motor 13. This control reduces the rotational speed of the engine 11 or the hydraulic pump 12, thus facilitating the operation of driving the hydraulic motor 13 at low speeds.

For example, for finely manipulating the suspended load 15, the conventional hydraulic driving apparatus permits an operation for reducing the rotation speed of the engine 11 to reduce a lowering speed of the hydraulic motor 13 to be performed, while the hydraulic driving apparatus 1 shown in FIG. 1 does not permit the lowering speed of the hydraulic motor 13 to be reduced, even if the rotation speed of the engine 11 is reduced. Specifically, even if the rotation speed of the engine 11 is reduced and thereby a discharge rate of the hydraulic pump 12 (=a meter-in flow rate Qmi) is reduced, the regeneration flow rate Qr supplements a deficiency in the meter-in flow rate Qmi relative to a meter-out flow rate Qmo, thus preventing the hydraulic motor 13 from being decelerated (the hydraulic motor 13 is rotated only by a self-weight of the suspended load 15). This makes it difficult to finely manipulate the suspended load 15. On the other hand, according to the hydraulic driving apparatus 401 shown in FIG. 12, the rotational speed of the hydraulic motor 13 can be reduced when the rotation speed of the engine 11 is reduced, which allows the fine manipulation of the suspended load 15 to be easily performed in the same feeling as that in the conventional hydraulic driving apparatus.

Figure 15:
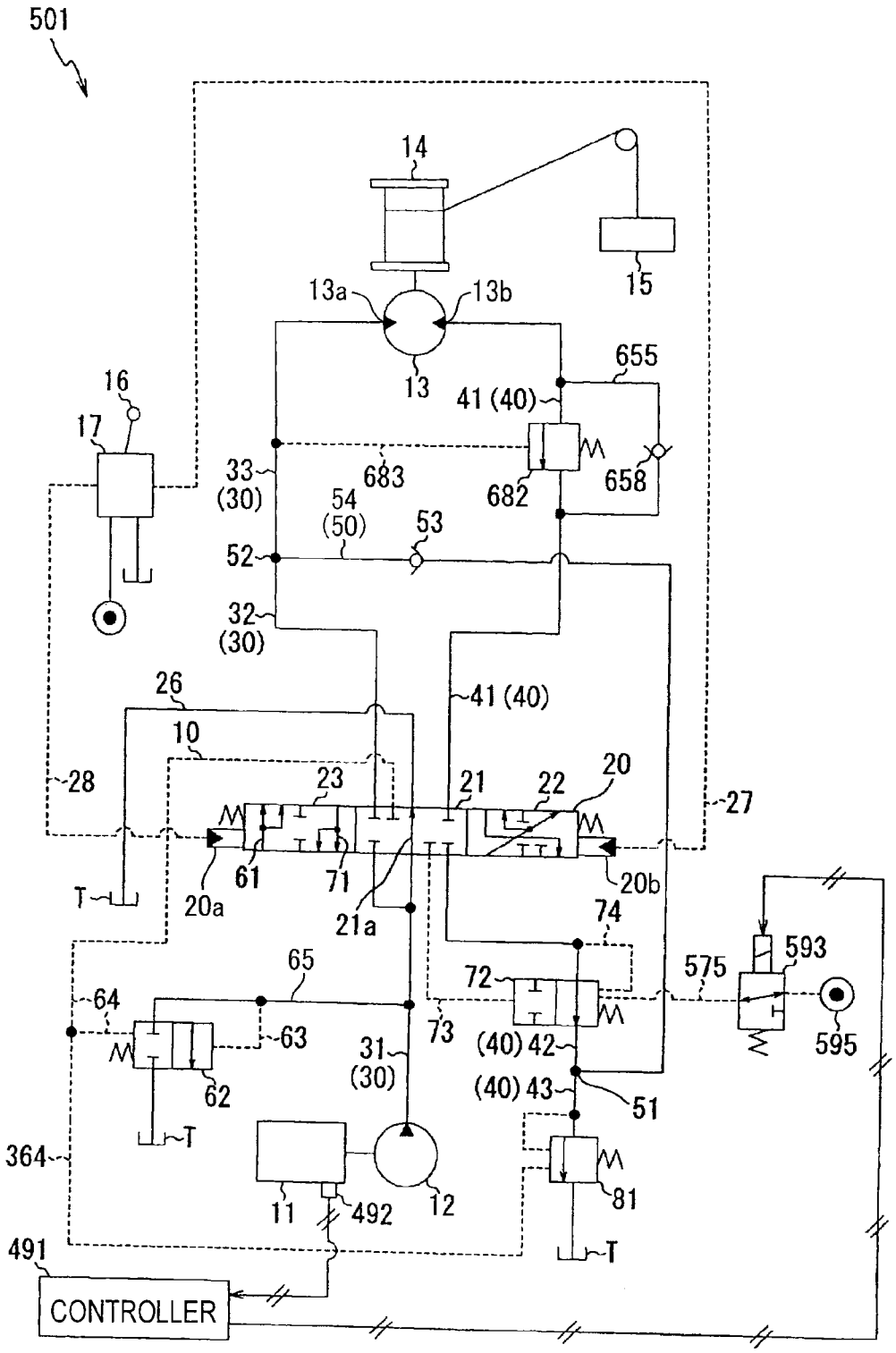
FIG. 15 is a circuit diagram showing a hydraulic driving apparatus, for a working machine, according to a fifth embodiment of the present invention.

With reference to FIG. 15, a fifth embodiment of the present invention will be described below.

FIG. 15 shows a hydraulic driving apparatus 501 according to the fifth embodiment. The hydraulic driving apparatus 501 is different from the working hydraulic driving apparatus 401 shown in FIG. 12 in the following points. While the working hydraulic driving apparatus 401 shown in FIG. 12 allows the meter-out flow rate Qmo to be reduced when the rotational speed of an engine 11 or the hydraulic pump 12 is reduced, by the reduction in the valve opening degree of the meter-out orifice 71, the hydraulic driving apparatus 501 shown in FIG. 15 allows the meter-out flow rate Qmo to be reduced when the rotational speed of an engine 11 or the hydraulic pump 12 is reduced, by the reduction in the input-output pressure difference of the meter-out orifice 71 (=the set pressure difference ΔPmo of a meter-out flow regulation valve 72). Besides, while the working hydraulic driving apparatus 401 shown in FIG. 12 includes the solenoid-operated pressure reducing valve 493 provided in the lowering-side pilot line 28, the hydraulic driving apparatus 501 shown in FIG. 15 comprises a pilot fluid pressure source 595, a pilot line 575 connecting the pilot fluid pressure source 595 to the meter-out flow regulation valve 72, and a solenoid-operated pressure reducing valve 593 provided in the pilot line 575.

The solenoid-operated pressure reducing valve 593 is designed to control the set pressure difference ΔPmo of the meter-out flow regulation valve 72. Specifically, the solenoid-operated pressure reducing valve 593 is operable to reduce an fluid pressure output from the pilot fluid pressure source 595 and thereafter apply the reduced fluid pressure, for example, to a spring chamber of the meter-out flow regulation valve 72. In other words, input into the meter-out flow regulation valve 72 as a pilot pressure is an outlet pressure of the solenoid-operated pressure reducing valve 593. The controller 491 inputs an electric control signal into the solenoid-operated pressure reducing valve 593 to change the outlet pressure thereof, thereby controlling the set pressure difference ΔPmo of the meter-out flow regulation valve 72.

In the hydraulic driving apparatus 501, when the rotational speed of the engine 11 as a driving power source for the hydraulic pump 12 or the rotational speed of the hydraulic pump 12 is reduced, the controller 491 performs the control for reducing the set pressure difference ΔPmo (see the formula 3) of the meter-out flow regulation valve 72, thereby reducing the flow rate Qmo (see the formula 3) in the meter-out fluid passage 40 and the rotational speed of the hydraulic motor 13. This reduces the rotational speed of the engine 11 or the hydraulic pump 12, thus facilitating the operation of driving the hydraulic motor 13 at low speeds.

Next will be described an explanation about the safety-ensuring pressure control valve 682 shown in FIG. 10.

The safety-ensuring pressure control valve 682 is adapted to be closed in emergency situations, for example, in the event of breakage of the meter-in fluid passage 30, to thereby decelerate the hydraulic motor 13. The safety-ensuring pressure control valve 682, provided in the meter-out fluid passage 40 at a position upstream of the branching point 51, is configured to be closed when the meter-in pressure Pmi is lower than a set pressure P3 of the safety-ensuring pressure control valve 682. The meter-in pressure Pmi is input into the safety-ensuring pressure control valve 682, through a pilot line 683, as a pilot pressure. Hence, with a focus on only the safety-ensuring pressure control valve 682 itself, the safety-ensuring pressure control valve 682 has the same structure as that of the conventional external pilot-operated counterbalance valve 784 (see FIG. 16). The pilot line 683 is, however, not provided with the orifice 786 as shown FIG. 16. The safety-ensuring pressure control valve 682 is therefore closed immediately after the meter-in pressure Pmi becomes lower than the set pressure P3.

The set pressure P3 (cracking set pressure) of the safety-ensuring pressure control valve 682 is slightly lower than the set back pressure Pbk (=the pressure P1, etc.) of the back pressure 81. In the case where the set back pressure Pbk is variable (see FIG. 11), the set pressure P3 is set to be lower than the pressure P1 which is the maximum pressure of the set back pressure Pbk.

To the meter-out fluid passage 40 is connected a bypass fluid passage 655 for raising in parallel with the safety-ensuring pressure control valve 682. The bypass fluid passage 655 for raising is one for supplying the hydraulic fluid from the hydraulic pump 12 to the hydraulic motor 13, during the raising drive mode, bypassing the safety-ensuring pressure control valve 682. The bypass fluid passage 655 for raising is provided with a check valve 658 adapted to permit hydraulic fluid to flow only in a direction from the hydraulic pump 12 to the second port 13*b* of the hydraulic motor 13.

The safety-ensuring pressure control valve 682 is normally opened. Specifically, upon manually operating the manipulation lever 16 in the direction for the lowering drive mode, the meter-in pressure Pmi immediately reaches the set back pressure Pbk of the back pressure valve 81, which keeps the safety-ensuring pressure control valve 682 fully opened, because the set back pressure Pbk is greater than the set pressure P3. In other words, during a normal lowering drive mode, the safety-ensuring pressure control valve 682 does not perform an opening-closing action, differently from the conventional external pilot-operated counterbalance valve 784 as shown in FIG. 16.

On the other hand, in an emergency situation where the meter-in Pmi becomes equal to or lower than the set back pressure Pbk of the back pressure valve 81, for example, due to breakage of the meter-in fluid passage 30, the safety-ensuring pressure control valve 682 is closed or its valve opening degree is significantly reduced, at a time when the meter-in Pmi becomes equal to or lower than the set pressure P3 of the safety-ensuring pressure control valve 682, which reduces the meter-out flow rate Qmo to zero or a value close to zero. This enables the hydraulic motor 13 to be effectively decelerated and make an emergency stop.

In summary, the safety-ensuring pressure control valve 682 is moved in a valve closing direction to significantly reduce the flow rate of the meter-out fluid passage 40 in an emergency or failure situation, for example, in the event of breakage of the meter-in fluid passage 30, at a time when the pressure of the meter-in fluid passage 30 (meter-in pressure Pmi) becomes lower than the set pressure P3 of the safety-ensuring pressure control valve 682, thereby effectively decelerating or stopping the hydraulic motor 13. This enhances safety in the emergency or failure situation. Besides, the safety-ensuring pressure control valve 682, which is provided upstream of the branching point 51, can prevent hydraulic fluid from flowing through the regeneration fluid passage 50 when closed. Thus, the hydraulic motor 13 is reliably decelerated.

The present invention permits the arrangement of the components and the connection of the hydraulic lines in the circuit shown in FIG. 1 to be appropriately modified.

For example, the pilot lines 64, 73 shown in FIG. 1, which are branched from the meter-in fluid passage 30 and the meter-out fluid passage 40 within the direction selector valve 20, respectively, may be branched outside the direction selector valve 20.

While, in the above embodiments, the hydraulic fluid supplied from the hydraulic pump 12 to the hydraulic motor 13 is returned directly to the tank T, the hydraulic fluid discharged from the hydraulic motor 13 may be further supplied to another hydraulic actuator (not shown) or the like. For example, there may be configured a circuit in which hydraulic fluid supplied from the hydraulic pump 12 to a main raising/lowering motor (hydraulic motor 13) is further supplied to an auxiliary raising/lowering motor (not shown) and then returned to the tank T, namely, a series circuit.

This application is based on Japanese Patent applications No. 2011-108293 and No. 2011-209678 filed in Japan Patent Office on May 13, 2011 and Sep. 26, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A hydraulic driving apparatus provided in a working machine to move a load in a same direction as a direction along which the load falls by its self-weight, comprising:

a hydraulic pump;

a hydraulic actuator adapted to be driven by hydraulic fluid supplied from the hydraulic pump to move the load;

a manipulation device having a manipulation member to be manually operated to designate an operating speed of the hydraulic actuator;

a meter-in flow control device for controlling a meter-in flow rate which is a flow rate in a meter-in fluid passage for the hydraulic actuator;

a meter-out flow control device for controlling a meter-out flow rate which is a flow rate in a meter-out fluid passage for the hydraulic actuator, the meter-out flow control device including a meter-out orifice provided in the meter-out fluid passage for the hydraulic actuator and configured to have an opening degree variable depending on an operation amount of the manipulation member, and a meter-out flow regulation valve receiving inputs of respective pressures on upstream and downstream sides of the meter-out orifice changing the flow rate in the meter-out fluid passage to keep an inlet-outlet pressure difference of the meter-out orifice at a constant set pressure difference, the inlet-outlet pressure difference being a difference between the pressures on the upstream and downstream sides of the meter-out orifice;

a back pressure valve provided downstream of the meter-out orifice and downstream of the meter-out flow regulation valve to produce a set back pressure on an upstream side thereof;

a regeneration fluid passage branched from the meter-out fluid passage at a position upstream of the back pressure valve and merged with the meter-in fluid passage; and a check valve provided in the regeneration fluid passage and adapted to allow hydraulic fluid to pass through the regeneration fluid passage only in a flow direction from the meter-out fluid passage to the meter-in fluid passage, wherein the meter-in flow control device is operable to control the meter-in flow rate in a region of the meter-in fluid passage upstream of a merging point with the regeneration fluid passage, and the meter-out flow control device is operable to control the meter-out flow rate in a region of the meter-out fluid passage upstream of a branching point of the regeneration fluid passage so as to make said meter-out flow rate be greater than said meter-in flow rate.

2. The hydraulic driving apparatus as defined in claim 1, wherein the meter-in flow control device includes: a meter-in orifice provided in the meter-in fluid passage; and a meter-in flow regulation valve for changing the flow rate in the meter-in fluid passage so as to keep an inlet-outlet pressure difference of the meter-in orifice at a constant set pressure difference.

3. The hydraulic driving apparatus as defined in claim 1, which further comprises a back pressure valve manipulation section adapted to increase an opening degree of the back pressure valve when a pressure of the meter-in fluid passage rises up to a given value or more.

4. The hydraulic driving apparatus as defined in claim 1, which further comprises a back pressure valve manipulation section adapted to increase an opening degree of the back pressure valve when the hydraulic actuator is so driven as to move the load in a direction opposite to the direction along which the load falls by its self-weight.

5. The hydraulic driving apparatus as defined in claim 1, which further comprises a controller adapted to operate the meter-out flow control device so as to reduce the meter-out flow rate when a rotational speed of a driving power source for the hydraulic pump or a rotational speed of the hydraulic pump is reduced.

6. The hydraulic driving apparatus as defined in claim 1, which further comprises a safety-ensuring pressure control valve provided in the region of the meter-out fluid passage upstream of the branching point of the regeneration fluid passage from the meter-out fluid passage, the safety-ensuring pressure control valve having a set pressure lower than the set back pressure of the back pressure valve and being adapted to be operated in a valve closing direction when a pressure of the meter-in fluid passage is lower than the set pressure of the safety-ensuring pressure control valve.

* * * * *